US006674976B2

(12) United States Patent
Sato et al.

(10) Patent No.: US 6,674,976 B2
(45) Date of Patent: Jan. 6, 2004

(54) SHEET POST-PROCESSING DEVICE, IMAGE FORMING APPARATUS HAVING THE DEVICE AND ERROR HANDLING METHOD THEREFOR

(75) Inventors: Kaoru Sato, Kanagawa (JP); Yasuyoshi Hayakawa, Shizuoka (JP); Takashi Kuwata, Shizuoka (JP); Mitsuhide Takamura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/094,975

(22) Filed: Mar. 12, 2002

(65) Prior Publication Data

US 2002/0131786 A1 Sep. 19, 2002

(30) Foreign Application Priority Data

Mar. 13, 2001 (JP) ..... 2001-071034
Mar. 13, 2001 (JP) ..... 2001-071036

(51) Int. Cl.[7] ..... G03G 15/00
(52) U.S. Cl. ..... 399/18; 270/58.09; 399/410
(58) Field of Search ..... 399/18, 82, 407, 399/408, 410, 16; 270/58.04, 58.09

(56) References Cited

U.S. PATENT DOCUMENTS 5,172,138 A 12/1992 Okazawa et al. ..... 346/134
5,700,006 A 12/1997 Sekiya et al. ..... 271/241
5,713,060 A 1/1998 Sato et al. ..... 399/20
5,875,373 A 2/1999 Sato et al. ..... 399/68
6,206,369 B1 3/2001 Hoshii et al. ..... 271/290
6,318,718 B1 11/2001 Ogata et al. ..... 271/213
6,325,371 B1 12/2001 Araki et al. ..... 271/297
6,382,614 B1 5/2002 Fukatsu et al. ..... 270/58.11

FOREIGN PATENT DOCUMENTS

EP 1 067 440 A2 * 1/2001
JP 11-189365 A * 7/1999

* cited by examiner

*Primary Examiner*—Joan Pendegrass
(74) *Attorney, Agent, or Firm*—Fitzpatrick, Cella, Harper & Scinto

(57) ABSTRACT

Provided are a post-processing device, an image forming apparatus having the post-processing device and an error handling method therefor. A conveyed sheet is temporarily stacked on a pair of slide guides (310, 311), and after post-processing such as stapling is conducted on the sheets, the slide guides (310, 311) are opened to drop down the sheets on a face-down discharge portion (125) on an upper surface of a printer (100). If the number of sheets temporarily stacked on the slide guides (310, 311) exceeds the post-processing possible number of sheets, the slide guides (310, 311) are opened to drop down the sheets on the face-down discharge portion (125). If the size of sheets to be post-processed is unsuitable for the post-processing, a flapper (301) is changed over so that the sheets transported from the printer main body (100) are discharged directly to the face-down discharge portion (125) and stacked thereon.

49 Claims, 19 Drawing Sheets

B

SHEET POST-PROCESSING DEVICE, IMAGE FORMING APPARATUS HAVING THE DEVICE AND ERROR HANDLING METHOD THEREFOR

BACKGROUND OF THE INVENTION

1. Field of the Invention

The present invention relates to a sheet post-processing device that subjects an image formed sheet to post-processing, an image forming apparatus having the device and an error handling method for the image forming apparatus having the sheet post-processing device.

2. Description of the Related Art

Up to now, there is an image forming apparatus such as a printer having a sheet post-processing device that puts respective end portions of a plurality of sheets on which an image has been formed (printed) in order and subjects the sheets to post-processing such as stapling before discharging the sheets. There has been known a type of sheet post-processing device, which are set at a side surface on a sheet discharge port side of an image forming apparatus main body. Sheets printed in the image forming apparatus main body are sequentially supplied to the device from the discharge port. The respective end portions of the sheets are put in order, and the sheets are subjected to post-processing. And then they are discharged.

However, the above-mentioned related art suffers from the following problems.

That is, in the image forming apparatus having the sheet post-processing device according to the related art, in order to discharge and stack the sheets that have been printed at the image forming apparatus main body side in the order of pages, it is necessary to dispose a switch-back mechanism for reversing the sheets at the sheet post-processing device side, or there is such a disadvantage that sheet intervals must be made long for switching back. Also, since the sheet post-processing device is disposed next to the sheet discharge port on the side surface of the image forming apparatus main body, there are disadvantages in that not only an area where the entire apparatus is located increases but also the costs become high.

In addition, there are many sheet post-processing devices that require an additional period of time or mechanism for error handling. For example, in the case where the number of sheet materials that exceed a stapling permissible number of sheets are stacked on a staple try, a conventional sheet post-processing device requires a control means that does not allow a succeeding sheet to be transported to the sheet post-processing device, or requires a mechanism for temporarily stopping or retreating the sheets that have been already transported, in order to discharge a bundle of sheets.

SUMMARY OF THE INVENTION

The present invention has been made to solve the above-mentioned problems with the related art, and therefore an object of the present invention is to provide a sheet post-processing device having a control means that facilitates error handling operation in the case where the number of sheets exceeds a post-processing permissible number of sheets, an image forming apparatus having the device, and an error handling method therefor.

Another object of the present invention is to provide a sheet post-processing device that appropriately processes a sheet that does not need to be post-processed to improve the utility, an image forming apparatus having the device, and an error handling method therefor.

According to the present invention, there is provided a sheet post-processing device, comprising: a first sheet discharge path through which a sheet transported from an image forming apparatus is transported to sheet stacking means disposed in the image forming apparatus; first sheet discharge path open/close means which is disposed in the first sheet discharge path, and closes the first sheet discharge path to temporarily support the sheet transported from the image forming apparatus, or opens the first sheet discharge path to transport the sheet transported from the image forming apparatus to the sheet stacking means; processing means which is disposed in the first sheet discharge path and conducts post-processing with respect to the sheet temporarily supported by the first sheet discharge path open/close means; sheet discharge path change-over control means that controls sheet discharge path change-over means that changes over a discharge path, to which the sheet discharged from said image forming apparatus is discharged, to said first sheet discharge path or a second sheet discharge path through which the sheet discharged from said image forming apparatus is discharged directly to said sheet stacking means; error handling operation necessity judging means that judges whether error handling operation that should be conducted with respect to a sheet unsuitable for the post-processing by the processing means is conducted, or not; and error handling operation means that controls at least one of the first sheet discharge path open/close means and the sheet discharge path change-over means to conduct the error handling operation.

Also, a sheet post-processing device comprises: measuring means that measures the number of sheets that are temporarily supported by the first sheet discharge path open/close means; storing means that stores the number of post-processing permissible sheets N which can be post-processed in the processing means; and comparing means that compares the number of sheets M measured by the measuring means with the number of sheets N stored by the storing means, and it is preferable that the error handling operation necessity judging means judges that the error handling operation is conducted if a result made by the comparing means satisfies a relationship of M>N; and that the error handling means controls the first sheet discharge path open/close means so as to open the first sheet discharge path to transport the sheet temporarily supported by the first sheet discharge path open/close means to the sheet stacking means.

Also, a sheet post-processing device comprises communication means that conducts communication with the image forming apparatus, and it is preferable that when the error handling operation necessity judging means judges that the error handling operation is conducted on the basis of information on the sheets that are going to be post-processed in the processing means which is transmitted from the image forming apparatus by the communication means, the error handling means controls the sheet discharge path change-over means so as to transport the sheets transported from the image forming apparatus to the second sheet discharge path.

Also, according to the present invention, there is provided an error handling method with respect to a sheet that is not suitable for post-processing in an image forming apparatus having a sheet post-processing device that conducts the post-processing on the discharged sheet, in which the sheet post-processing device comprises: a first sheet discharge path through which the sheet transported from the image forming apparatus is transported to sheet stacking means disposed in the image forming apparatus; first sheet discharge path open/close means which is disposed in the first sheet discharge path, and closes the first sheet discharge path to temporarily support the sheet transported from the image forming apparatus, or opens the first sheet discharge path to transport the sheet transported from the image forming apparatus to the sheet stacking means; and processing means which is disposed in the first sheet discharge path and conducts post-processing with respect to the sheet temporarily supported by the first sheet discharge path open/close means; in which the image forming apparatus comprises: image forming means that forms an image on the sheet; the sheet stacking means; and sheet discharge path change-over means that changes over a discharge path, to which the sheet discharged from said image forming apparatus is discharged, to any one of the first sheet discharge path and a second sheet discharge path along which the sheet discharged from the image forming apparatus is discharged directly to the sheet stacking means; and the method comprises the steps of: judging whether the error handling operation is conducted or not; and if the error handling operation is conducted, controlling at least any one of the first sheet discharge path open/close means and the sheet discharge path change-over means to conduct the error handling operation.

Also, it is preferable that the error handling method further comprises the steps of: comparing the number of sheets M that are temporarily supported by the first sheet discharge path open/close means with the number of post-processing permissible sheets N which can be post-processed in the processing means; judging that the error handling operation is conducted if a relationship of M>N is satisfied; and if the error handling operation is conducted, opening the first sheet discharge path to transport the sheets temporarily supported by the first sheet discharge path open/close means to the sheet stacking means.

Also, it is preferable that the error handling method in which information on the sheets that are going to be post-processed in the sheet processing means from the image forming apparatus to the sheet post-processing device; and if it is judged that the error handling operation is conducted on the basis of the sheet information, and controlling the sheet discharge path change-over means so as to guide the sheets transported from the image forming apparatus to the second sheet discharge path.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Now, a description will be given in more detail of preferred embodiments of the present invention with reference to the accompanying drawings. The dimensions, the material, the configurations of the structural parts and the relative arrangements of those structural parts described in the embodiments of the present invention do not limit the scope of the present invention so far as no specific description is made.

In the following respective embodiments, a sheet post-processing device equipped with an image forming apparatus represented by a laser beam printer will be exemplified.

(First Embodiment)

First, a first embodiment of the present invention will be described with reference to FIGS. 1 to 6.

Figure 1:
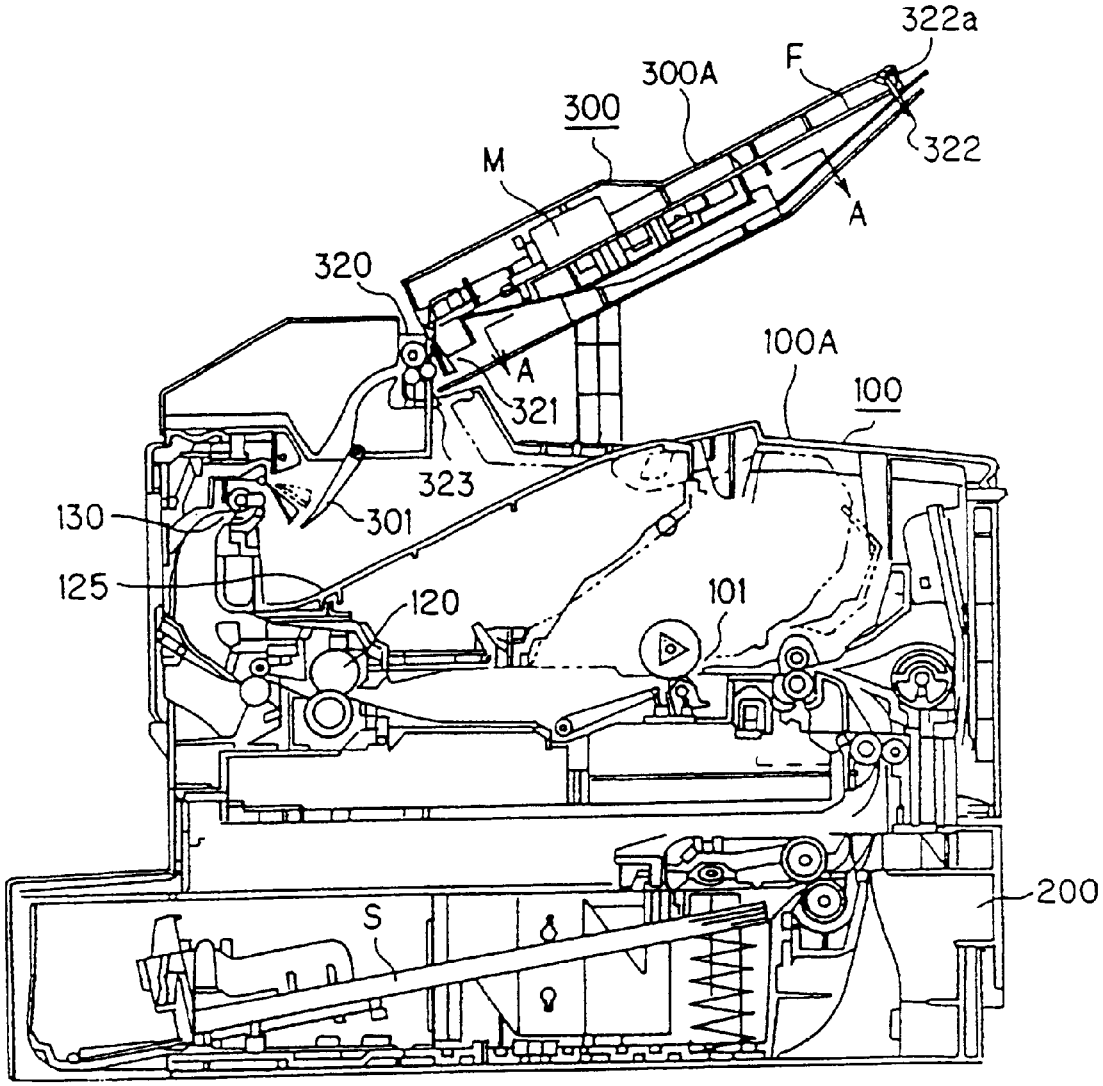
FIG. 1 is a cross-sectional view showing a printer equipped with a sheet post-processing device in accordance with a first embodiment.

FIG. 1 is a schematic cross-sectional view showing the entire structure of a sheet post-processing device and an image forming apparatus (printer) in accordance with a first embodiment.

Referring to FIG. 1, reference numeral 100 denotes a printer main body that functions as an image forming apparatus, which is connected to a computer, independently, or connected to a network such as LAN, forms (prints) an image on a sheet through a given image forming process on the basis of image information or a print signal which are transmitted from the computer or the network and discharges the printed sheet.

On the other hand, a sheet post-processing device 300 takes up the sheets discharged from the printer main body 100 to the external by a flapper 301 that functions as a sheet discharge path change-over means, stacks the sheets on a face down discharge portion 125 that functions as a sheet stacking means through a transporting portion within the sheet post-processing device in a face down state where an image surface of the sheet is directed downward, aligns the sheets due to a sheet aligning means, bundles the sheets for each of given jobs, staples the sheets at one position or a plurality of positions, and discharges and stacks the sheets, or merely discharges and stacks the sheets in the face down state.

In this example, the sheet post-processing device 300 and the printer main body 100 are electrically connected to each other through a cable connector not shown, and used as a communication means that transfers various information. Also, the sheet post-processing device 300 includes a casing portion 300A that stores the respective portions therein, and is detachably attachable with respect to the apparatus main body 100A of the printer main body 100 which will be described later.

Subsequently, the structure of the respective portions of the printer main body 100 will be described along a transporting path of the sheet S which will be transported.

In the printer main body 100, a plurality of sheets S are stacked within a sheet feeding cassette 200, and the uppermost sheet among the plurality of sheets is sequentially separated and fed by various rollers one by one. Then, a toner image is transferred onto an upper surface of the sheet S fed, in response to a given print signal supplied from the computer or the network, from the sheet feeding cassette 200 by an image forming portion 101 that forms a toner image through an image forming process of a so-called laser beam system within the printer main body 100, and then a heat and a pressure are applied to the sheet on which the toner image has been transferred by a fixer 120 at a downstream side thereof, to thereby permanently fix the toner image.

The sheet S onto which the image has been fixed is turned back in a substantially U-shaped sheet transporting path that reaches a discharge roller 130 to reverse the image surface as shown in FIG. 1, and is then face-down-discharged from the printer main body 100 to the external by the discharge roller 130 in a state where the image surface is directed downward. In this situation, the position of the flapper 301 of the sheet post-processing device 300 is determined on the basis of a control signal from a control portion not shown, to thereby select whether the sheet S is discharged as it is to a face-down (FD) discharge portion 125 disposed on an upper portion of the printer main body 100 (second sheet discharge path), or discharged through the sheet post-processing device 300 (first sheet discharge path).

Then, a description will be given of the structure of the sheet post-processing device 300 and the actions of the respective portions in the case where the sheet S transported from the discharge roller 130 is transported toward the sheet post-processing device 300 with reference to FIGS. 2 to 4. In this example, FIGS. 2 and 3 show cross-sectional views of the discharge roller 130 and the sheet post-processing device 300, FIG. 4A is a cross-sectional view of the sheet post-processing device 300 taken along a line A—A of FIG. 1, and FIG. 4B is a cross-sectional view taken along a line B—B of FIG. 4A.

Figure 2:
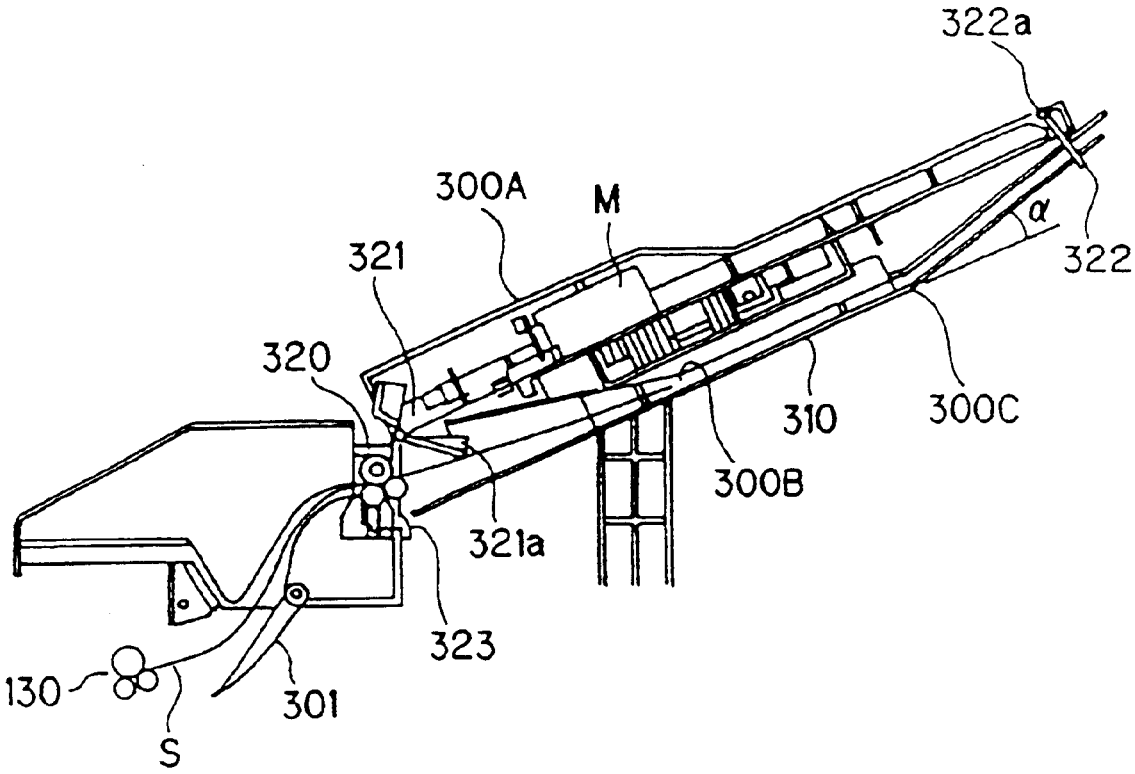
FIG. 2 is an explanatory diagram showing the operation of the sheet post-processing device in accordance with the first embodiment.
Figure 3:
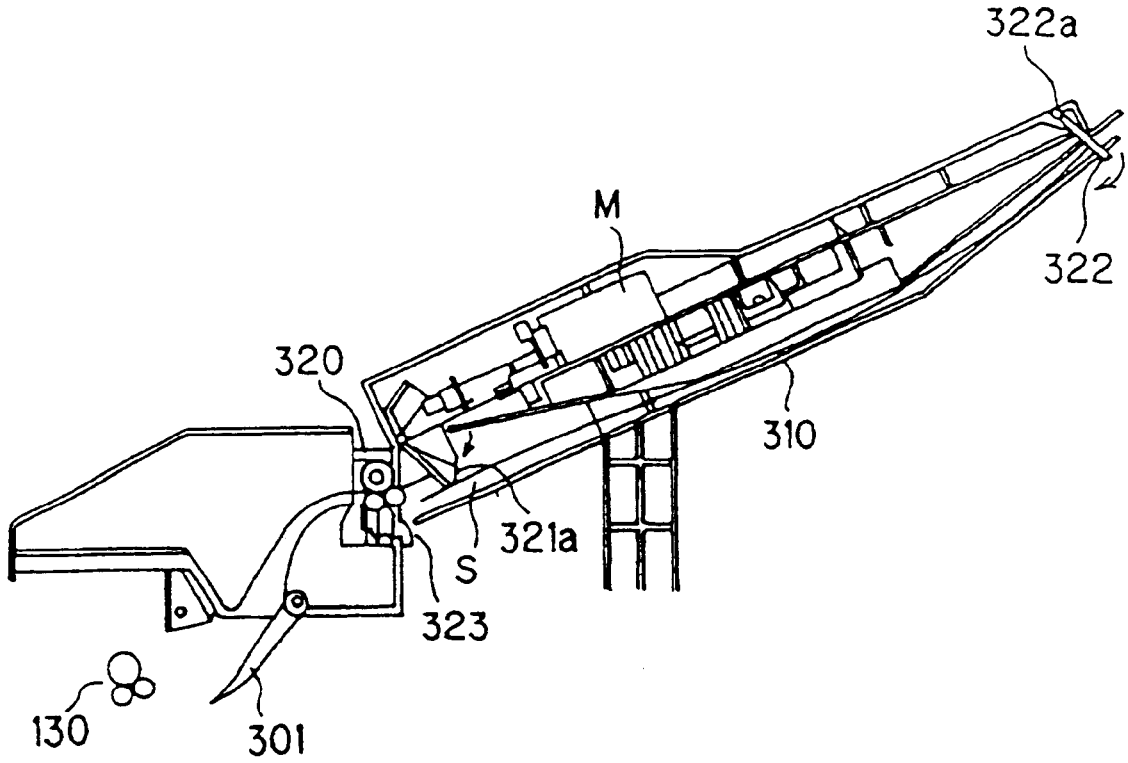
FIG. 3 is an explanatory diagram showing the operation of the sheet post-processing device in accordance with the first embodiment.
Figure 4:
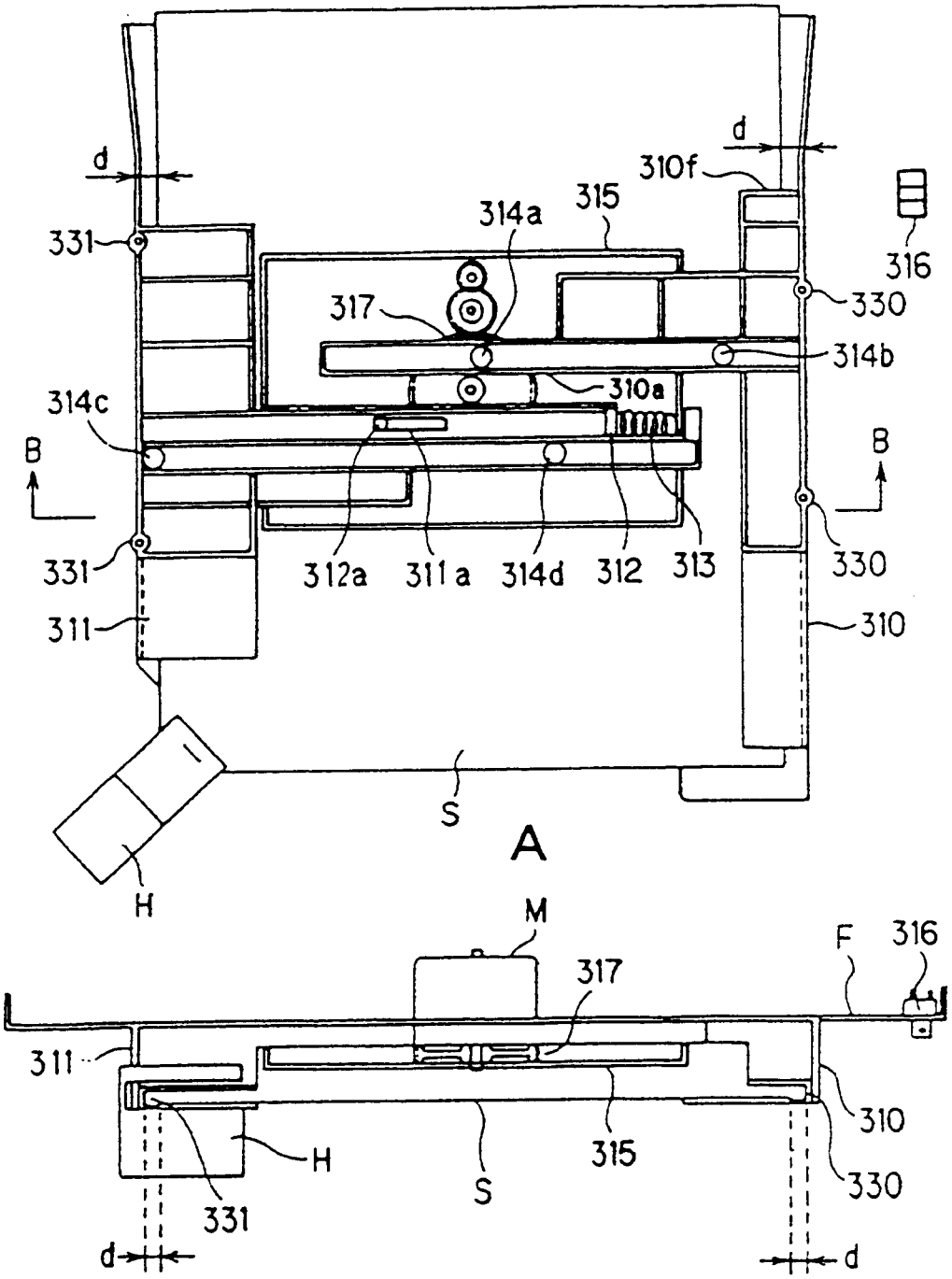
FIGS. 4A and 4B are cross-sectional views for explaining the operation of slide guides in accordance with the first embodiment.
Figure 5:
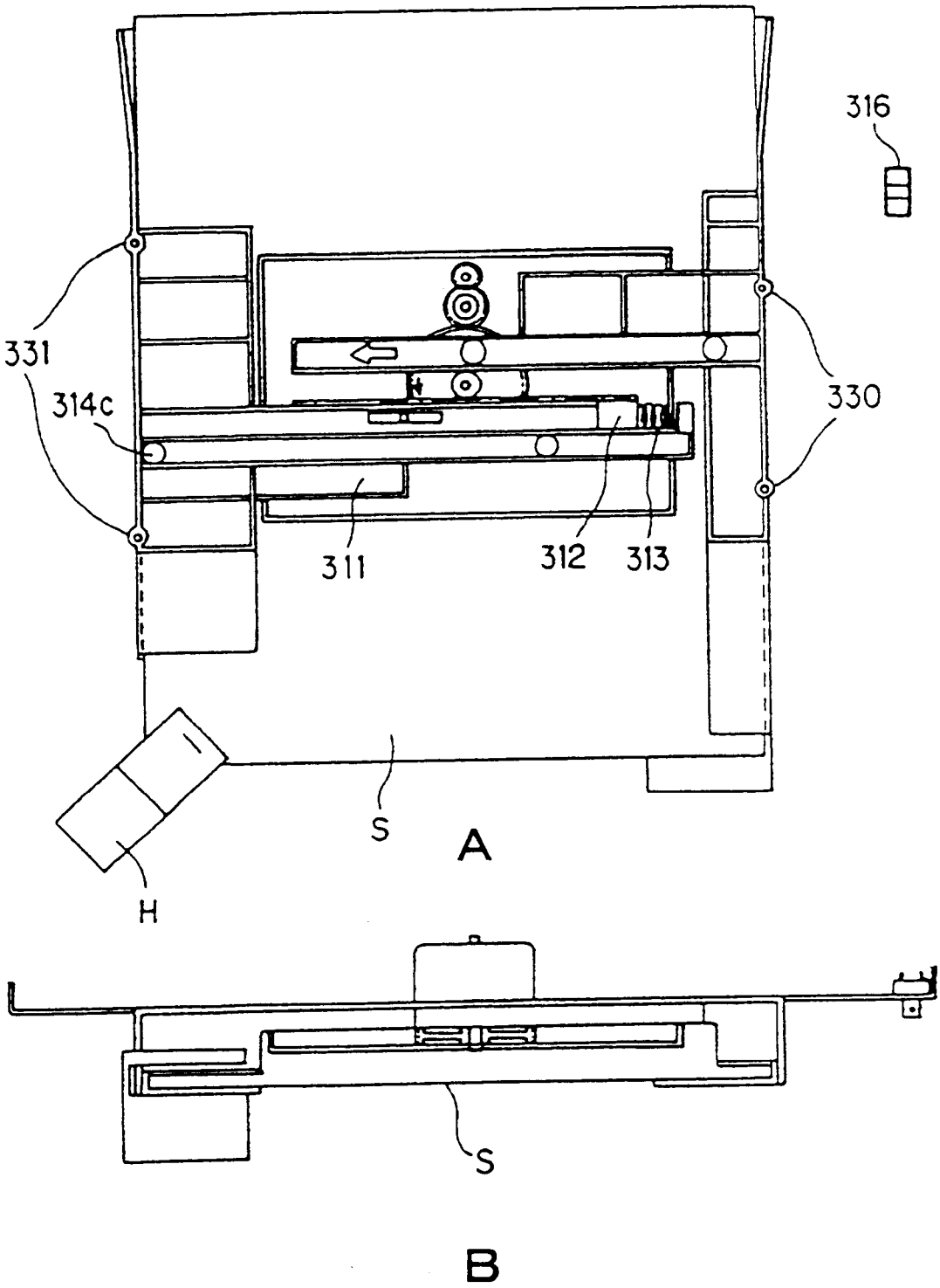
FIGS. 5A and 5B are cross-sectional views for explaining the operation of the slide guides in accordance with the first embodiment.
Figure 6:
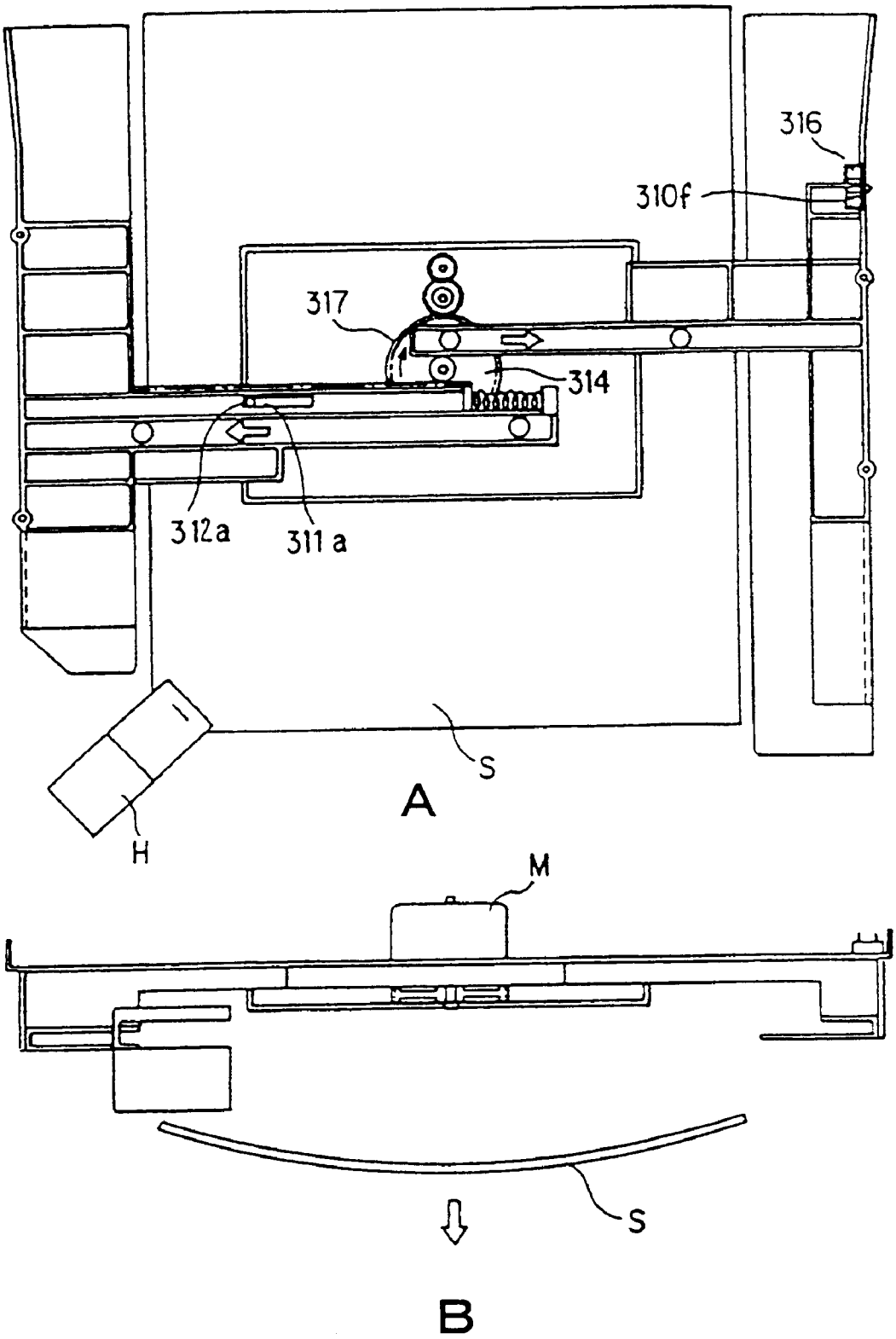
FIGS. 6A and 6B are cross-sectional views for explaining the operation of the slide guide in accordance with the first embodiment.

FIGS. 2 and 3 are diagrams for explaining the operation of the sheet post-processing device in accordance with the first embodiment.

In FIGS. 2 and 3, reference numeral 320 denotes a transporting roller, 321 is a discharge sensor, M is a jogger motor that functions as a driving source, 322 is a sheet return member, and 323 is a reference wall against which a sheet trailing edge is abutted.

As shown in FIGS. 2 and 3, the transporting roller 320 is disposed at the upper side of the downstream of the above-mentioned flapper 301 in the sheet transporting direction, and rotationally driven by a driving motor not shown. Also, the discharge sensor 321 is disposed in the vicinity of the downstream side of the transporting roller 320 in the sheet transporting direction, and detects the leading edge and the trailing edge of the sheet transported by the transporting roller 320. The jogger motor M is a motor for driving a slide guide R310 and a slide guide L311 which will be described later, and a stepping motor is employed in this embodiment.

The sheet return member 322 is disposed at the most downstream side in the sheet post-processing device 300 and is rotatable about a support shaft portion 322*a* as an axis. In this example, FIG. 2 shows an initial position of the sheet return member 322, and FIG. 3 shows a state in which the sheet return member 322 is pushed up by the sheet S.

When the sheet return member 322 that has a given weight is pushed up by an external force counterclockwise in FIG. 2, the sheet return member 322 is going to rotate by its weight in a direction indicated by an arrow in FIG. 3 (clockwise). As a result, the trailing edges of the sheets are aligned at the reference wall 323, and the sheets are stacked.

FIGS. 4A and 4B are cross-sectional views for explanation of the operation of the slide guides that function as a first sheet discharge path open/close means and a sheet aligning means of the sheet post-processing device in accordance with the first embodiment.

As shown in FIGS. 4A and 4B, in the sheet post-processing device 300 according to this embodiment, there are disposed the slide guide R310 and the slide guide L311 which will be described in more detail later as guide members for aligning the sheets in the width direction.

In the sheet post-processing device 300, in the case where a stapling operation is conducted on the basis of a command outputted from the computer or the like in advance, before the sheet S to be stapled is discharged by the discharge roller 130, the flapper 301 rotates through a link not shown due to a solenoid not shown counterclockwise in FIG. 2. Then, when the end portion of the flapper 301 is positioned at a side lower than the nipping portion of the discharge roller 130 as shown in FIG. 2, the sheet S discharged from the discharge roller 130 to the external is drawn upward along the flapper 301, conveyed into the sheet post-processing device 300 and then conveyed to the first sheet stacking portion 300B for temporarily stacking the sheet S as shown in FIG. 2.

In this state, as shown in FIG. 4A, in the sheet post-processing device 300, the slide guide R310 and the slide guide L311 which are right and left with respect to the sheet conveying-in direction, respectively, retreat to positions external by a given amount in the width direction of the sheet S so that those slide guides R310 and L311 do not interfere with the conveyed sheet S, and wait for the entrance of the sheet S.

Then, in the sheet post-processing device 300, when a first sheet S is discharged from the discharge roller 130 of the printer main body 100, the sheet S is conveyed into the device main body 300A so as to be drawn up by the flapper 301, and then transported onto the guide surface of the first sheet stacking portion 300B made up of the slide guide R310 and the slide guide L311 by the transporting roller 320 that is rotationally driven by the driving motor not shown. The first sheet stacking portion 300B functions as a sheet supporting means which temporally supports the sheets conveyed in the post-processing device.

In this example, the guide surface of the first sheet stacking portion 300B is inclined at a given angle with respect to the horizontal direction and has inclined angles different between the upstream side and the downstream side in the sheet conveying-in direction as shown in FIG. 2. Specifically, a bent portion 300C bent at an inclined angle α is formed between a given upstream section and a given downstream section. The guide surface of the first sheet stacking portion 300B has the bent portion 300C, to thereby prevent the bending of the center portion of the sheet S which is not guided by the slide guide R310 and the slide guide L311.

Then, when the leading edge of the sheet S conveyed into the device main body 300A is detected by the discharge sensor 321 in the vicinity of the downstream side of the transporting roller 320, a flag 321*a* of the discharge sensor 321 is rotated counterclockwise in FIG. 2, and then when the trailing edge of the sheet S passes through the transporting roller 320, as shown in FIG. 3, the flag 321*a* rotates due to its weight clockwise in FIG. 2, as a result of which the sheet trailing edge is pushed downward under pressure, and the sheet S surely drops down to the guide surface made up of the slide guide R310 and the slide guide L311. In this time, the discharge sensor 321 turns off.

Also, when the leading edge of the sheet S pushes up the sheet return member 322 counterclockwise in FIG. 2, the sheet return member 322 rotates due to its weight in the reverse direction as described above, and the sheet trailing edge is abutted against the reference wall 323. As a result, the trailing edge portions of the respective sheets stacked on the first sheet stacking portion 300B in the transporting direction are aligned.

In the first embodiment, when the above-mentioned discharge sensor 321 turns off, only the right slide guide R310 operates, and the aligning operation of the respective sheets stacked on the first sheet stacking portion 300B in the width direction starts. Specifically, when the slide guide R310 is driven by the motor M and moves to the left side of FIG. 4, a reference pin R330 disposed on the slide guide R310 is abutted against the right side edge of the sheet S and pushes the sheet S toward the slide guide L311. Then, the left side edge of the sheet S is abutted against the reference pin L331 disposed on the slide guide L311, to thereby align the respective sheets in the width direction.

Now, the structure of the slide guides will be described in more detail.

FIGS. 4A and 4B are diagrams for explaining the structure of the slide guides taken along a line A—A of FIG. 1. FIGS. 5A, 5B, 6A and 6B are diagrams for explaining the operation of the slide guides.

The respective slide guide R310 and slide guide L311 can reciprocate in the right and left directions of FIGS. 4A and 4B, that is, in a direction perpendicular to the sheet transporting direction (sheet width direction) while being guided by guide pins 314 (314*a* to 314*d*) disposed on a frame F, and travel due to the transmission of a driving force from the jogger motor M.

When viewed from the sheet transporting direction, each of the slide guide R310 and the slide guide L310 is substantially U-shaped in cross section so as to have the respective wall portions that guide both sides of the sheet S and a support portion that supports the upper and lower surfaces of the sheet S, as shown in FIG. 4B, and is structured to support the respective sheets discharged onto the first sheet stacking portion 300B by the lower surface of the U-shape and not to support the center portion of the sheet S in the width direction.

The slide guide R310 is equipped with a rack portion 310*a* having a plate gear that is meshed with a stepped gear 317. On the other hand, the slide guide L311 is equipped with a slide rack L312 having a plate gear that is meshed with the step gear 317. In this example, the slide rack L312 is relatively movable with respect to the slide guide L311 through a coil spring 313. One end of the spring 313 is abutted against the slide guide L311, and the other end of the spring 313 is abutted against the slide rack L312 so as to urge toward a direction that widens the distance between the slide guide L311 and the slide rack L312. Also, the slide rack L312 has an emboss portion 312*a* that moves within a rectangular hole portion 311*a* of the slide guide L311 side.

Two reference pins R330 made of metal excellent in abrasion proof are disposed on side walls of the slide guide R310, and two reference pins L331 are disposed on side walls of the slide guide L311, and when the sheets are aligned, the slide guide R310 moves and the reference pin R330 and the reference pin L331 are abutted against both side edges of the sheets.

Also, the slide guide R310 and the slide guide L311 support are regulated in the height direction by the step gear 317 and a height regulating member 315.

In FIGS. 4A to 6B, reference H denotes a stapler that functions as a processing means of stapling the sheets. Since the stapler H staples the left upper corner portions of an image surfaces of the sheets on which an image has been formed to bind the respective sheets, the stapler is fixedly disposed to the slide guide L311 side.

Subsequently, the operation of the respective slide guides 310 and 311 will be described. When a power is supplied to the sheet post-processing device 300, the transporting roller 320 driven by the driving motor starts to rotate, and then the jogger motor M rotates to rotate the stepped gear 317, whereby the rack portion 310*a* of the slide guide R310 is driven and retreated outward. The slide guide L311 is retreated outward by being pushed by the emboss portion 312*a* after the slide rack 312 first relatively moves, and the emboss portion 312*a* of the slide rack 312 is abutted against the end surface of the rectangular hole portion 311*a* of the slide guide L311 at the left side of FIGS. 4A and 4B when the jogger motor M rotates so that the step gear 317 rotates.

The slide guide R310 is equipped with a flag portion 310*f*, and when the flag portion 310*f* moves to a given retreating distance, as shown in FIG. 6A, the flag portion 310*f* shields the photo sensor 316 from light, and at that time, the jogger motor M stops. The position is set as a home position.

When a signal that the sheet S enters the sheet post-processing device 300 is inputted to the sheet post-processing device 300 from the printer main body 100, the jogger motor M rotates, and the slide guide R310 and the slide guide L311 move inwardly, and as shown in FIGS. 4A and 4B, they stop at positions that are wider than the width of the entering sheet S by a given amount d. At this position, the slide guide L311 cannot be moved inward no longer since the guide pin 314*c* is abutted against the end portion. In the first embodiment, that position shown in FIGS. 4A and 4B is a waiting position at which the side surface of the slide guide L311 becomes a reference position at the time of aligning the sheets in order.

In this embodiment, in the case where the size (width) of the sheet S is the feedable maximum size, the waiting positions of the slide guide R310 and the slide guide L311 are set so that clearances at both sides thereof become given amounts d, respectively.

In the case where a sheet narrower in width than the maximum size is aligned by the sheet post-processing device 300, the slide guide R310 is moved leftward as much, as a result of which the clearance at the right side of FIGS. 4A and 4B at the waiting position becomes always a given amount d. On the other hand, in this case, a clearance between the sheet and the slide guide L311 is widened half of the narrowed amount.

When a first sheet S is discharged from the discharge roller 130 of the image forming apparatus 100, the sheet S is taken up by the flapper 301 and guided into the sheet post-processing device 300, and then transported to the respective slide guide R310 and slide guide L311 by the transporting roller 320.

In this situation, the sheet S is transported along the guide surfaces of the slide guide R310 and the slide guide L311 after the leading edge of the sheet S has been detected by the discharge sensor 321, and a corner portion at the left side of the leading edge of the sheet (the left lower corner portion of FIG. 4A) is inserted into the opening portion of stapler H. Also, the center portion of the leading edge of the sheet S is abutted against the sheet return member 322, and if the sheet S is forcible, after the sheet S pushes up the sheet return member 322 counterclockwise in FIG. 2 (a direction indicated by an arrow), the sheet return member 322 rotates clockwise due to its weight of the sheet S, to thereby align the trailing edge of the sheet S at the reference wall 323.

Also, substantially simultaneously when the above operation is conducted, when the trailing edge of the sheet S passes through the transporting roller 320, the flag 321*a* of the discharge sensor 321 rotates clockwise of FIG. 1 by its weight and returns, and when the discharge sensor 321 turns off, the trailing edge of the sheet is pushed downward by the flag 321*a* under pressure so as to surely drop toward the guide surface of the first sheet stacking portion 300B made up of the slide guide R330 and the slide guide L331.

In the first embodiment, when the discharge sensor 321 turns off, the jogger motor M starts to rotate, and the slide guides that are at the waiting positions starts the following sheet aligning operation. That is, when the sheet aligning operation starts, the jogger motor M rotates in a direction along which the slide guides move inward. In this situation, the slide guide L311 cannot move because it is abutted against the guide pin 314*c*, and only the slide rack 312 disposed on the slide guide L311 moves in a direction along which the spring 313 is compressed. Therefore, during the sheet aligning operation, since only the slide guide R310 moves, the reference pin R330 of the slide guide R310 is abutted against the right side edge of the sheet S, and the sheet S is moved toward the left side of FIGS. 4A and 4B so that its left side edge is abutted against the reference pin L331 of the slide guide L311, coming to a state shown in FIGS. 5A and 5B. In this situation, taking the deflection of the sheet into consideration, the slide guide R310 may be moved to a position where the distance between the slide guides R310 and L311 are narrower by a given amount than the width of the sheet S.

In the first embodiment, after the jogger motor M temporarily stops in a state of FIGS. 5A and 5B where both end portions of the sheet S are abutted against the slide guide R310 and the slide guide L311, the jogger motor M starts reverse rotation, and then stops when the slide guide R310 again moves to the waiting position of FIGS. 4A and 4B. The control for the amount of movement of the slide guide R310 during the above operation is managed by the number of drive pulses of the jogger motor M which is a stepping motor on the basis of the home position where the photosensor 316 is shielded from light. Similarly, at the slide guide L311 side, since only the slide rack 312 moves in a direction along which the spring 313 is stretched and the slide guide L311 per se is held to the reference position without being moved, the left side end portion of the sheet S in FIGS. 5A and 5B is in a state where it remains abutted against the slide guide L311.

Then, when a second sheet (S2) is transported to the sheet post-processing device as in the first sheet S, the trailing edge of the sheet (S2) is allowed to drop down to the first sheet stacking portion 300B by the weight of the flag 321*a* at the point in time where the trailing end of the sheet (S2) has passed through the transporting roller 320. Thereafter, when the discharge sensor 321 turns off, the sheet aligning operation starts as in the case of the first sheet. That is, the jogger motor M rotates, the slide guide R310 moves, the reference pin R330 is abutted against the side edge of the sheet (S2), and the left side edge of the sheet (S2) is moved until it is abutted against the reference pin L331 disposed on the slide guide L311, to thereby align the left side end portions of two sheets. Thereafter, the slide guide R310 moves up to the above-mentioned waiting position and stops.

The above operation is repeatedly conducted, the operation of aligning a final (n-th) sheet (Sn) of one job is conducted, the respective reference pins R330 disposed on the slide guide R310 abuts the left side edge of the sheet against the respective reference pins L331 of the slide guide L311, and in a state where the slide guide R310 stops moving as shown in FIGS. 5A and 5B, the position of the leading left side of a bundle of sheets is stapled by a compact stapler H positioned at the leading left side of the bundle of sheets.

According to the above structure and operation, during the operation of aligning the respective sheets, the slide guide L311 stops at the reference position so as not to move, and only the slide guide R310 moves whereby the left side end portions of the respective sheets are aligned at the reference position, as a result of which the binding operation made by the stapler H that is fixedly disposed at the slide guide L311 side is accurately and surely conducted. In addition, even in the case where the widths of the respective transported sheets are varied in one job or in the case where the sheet size changes, for example, from LTR to A4 in one job, since the positions of the left end portions of the respective sheets are constantly aligned, excellent advantages that the finishing of the binding operation by the stapler H becomes accurate and fine are obtained.

In the first embodiment, upon the completion of the above stapling operation, the jogger motor M is rotationally driven so that the slide guide R310 moves in a direction where it is widened from the state shown in FIGS. 5A and 5B. When the slide guide R310 starts to move, concerning the slide guide L311, the slide rack 312 moves toward the left side of FIGS. 5A and 5B, and the slide guide L311 side per se does not moves immediately.

Then, when the position of the slide guide R310 passes through the waiting position shown in FIGS. 4A and 4B, the emboss portion 312*a* of the slide rack 312 is abutted against the end surface of the rectangular hole portion 311*a* of the slide guide L311, and the slide guide L311 starts to move leftward in FIGS. 4A and 4B, to thereby move both the slide guides 310 and 311.

In addition the bundle of sheets that have been stapled drop down as shown in FIGS. 6A and 6B when a distance between both the supported slide guides 310 and 311 supporting the bundle of the sheets is equal to substantially the width of the sheets or wider than the width of the sheets. As a result, the bundle of sheets drop down to the face-down (FD) discharge portion (FD tray) 125 of the printer main body 100 that functions as a second sheet stacking portion and are then stacked one on another.

As described above, in the first embodiment, because the FD discharge portion 125 of the printer main body 100 is commonly employed as a member of stacking the bundle of sheets discharged from the sheet post-processing device 300 without providing an exclusive stacking portion, there can be provided the downsized and inexpensive sheet post-processing device.

Also, in the first embodiment, because the sheet post-processing device 300 is mounted on the upper portion of the device main body 100A of the printer main body 100 that functions as the image forming apparatus, and the transporting paths of the sheets discharged from the device main body 100A are changed over by the flapper 301, there can be provided an inexpensive sheet post-processing device that does not require a switch back mechanism in order to discharge and stack the sheets on which an image has been formed in order of pages, has no disadvantage that the interval of sheets must be made wide for conducting the switch back, and also does not increase an area where the device is located.

When the sheet S is discharged directly to the FD discharge portion 125 from the discharge roller 130 of the printer main body 100 immediately after the bundle of stapled sheets has been discharged to the FD discharge portion 125 of the printer main body 100, there is a fear that the leading edge of the sheet S is caught by the protruded binding portion of the bundle of sheets to damage the sheet S, or the line-up of the sheet S or the stapled sheets fails.

In order to prevent those drawbacks, after the bundle of sheets that have been subjected to the binding operation by the stapler H has been discharged to the FD discharge portion 125, the operation of the flapper 301 and relevant portions is controlled in such a manner that at least one succeeding sheet is stacked on the FD discharge portion 125 of the printer main body 100 through the sheet post-processing device 300 without discharging the sheet directly to the FD discharge portion 125. The operation enables the binding portion of the bundle of sheets previously discharged to be covered with a sheet S that drops down subsequently, thereby being capable of preventing the catching of the sheet S thereafter discharged directly to the FD discharge portion 125 from the printer main body 100.

In the first embodiment, during the sheet aligning operation, only the slide guide R310 operates and the slide guide L311 does not operate. Alternatively, during the sheet aligning operation, the slide guide L311 may also operate. This can be realized, for example, by making the slide guide L311 identical with the slide guide R310 in the structure.

In addition, in the first embodiment, in the case where the sheets which have been aligned drop downward, both of the slide guide R310 and the slide guide L311 are structured to operate. Alternatively, in the case where the sheets are allowed to drop downward, only any one of those slide guides R310 and L311 may operate.

Figure 7:
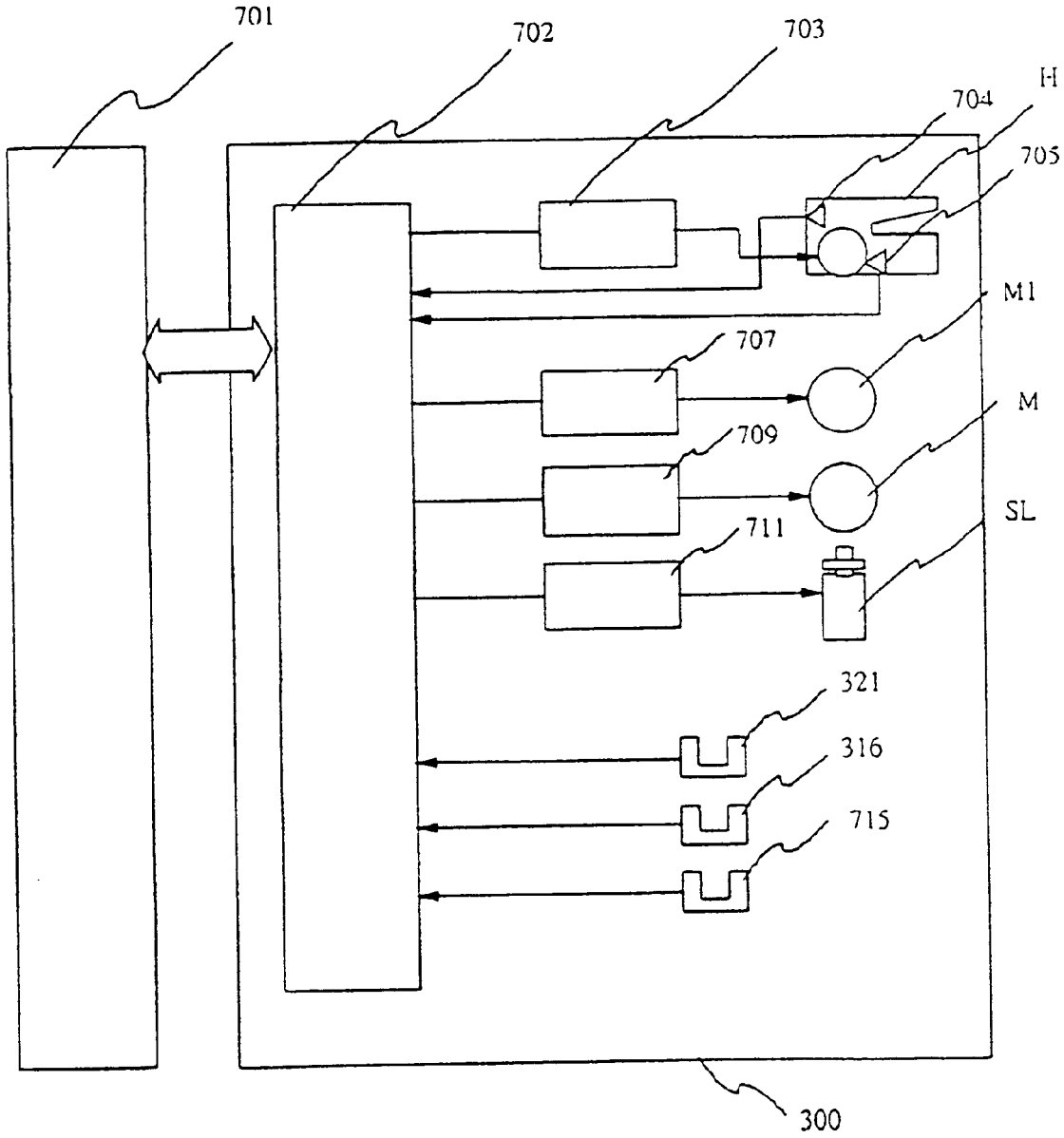
FIG. 7 is a block diagram showing the structure of electric components in the first embodiment.

FIG. 7 is a block diagram showing the structure of electric components in the sheet post-processing device in accordance with this embodiment.

The structure of the electric components of the sheet post-processing device 300 is made up of a control board not shown, the stapler H, the driving motor M1, the jogger motor M, the solenoid SL that operates the flapper, the discharge sensor 321, the home position sensor 316 of the slide guide R310 and the slide L321 (hereinafter referred to as "jogger HP sensor 316"), and a stacking amount sensor 715 that detects the amount of stacks on the FD discharge portion of the printer main body 100. On the control board are disposed a one-chip microcomputer (including a ROM and a RAM therein which functions a storing means) 702 (hereinafter referred to as "CPU 702"), a motor driver 703 that drives the stapler H upon receiving a control signal from the CPU 702, a driving motor driver 707 that rotates the driving motor M1 upon the control signal from the CPU 702 likewise, a jogger motor driver 709 that rotates the jogger motor M upon receiving the control signal from the CPU 702 likewise, and a solenoid driver 711 that drives the flapper solenoid SL upon receiving the control signal from the CPU 702 likewise.

Also, sensor signals from the discharge sensor 321, the jogger HP sensor 316 and the stacking amount sensor 715 are input into the CPU 702 to control the sheet post-processing device 300.

In addition, the CPU 702 conducts serial communication with an image controller 701 that is mounted on the printer main body 100 and transmits/receives information for controlling the printer main body 100 and the sheet post-processing device 300 to control those devices together with the image processing.

FIGS. 8 to 15 are flowcharts showing the control of the CPU 702 that functions as an error handling means, a sheet discharge path change-over control means and an error handling operation necessity judging means in the first embodiment. Hereinafter, the control of the CPU 702 will be described in order.

Figure 8:
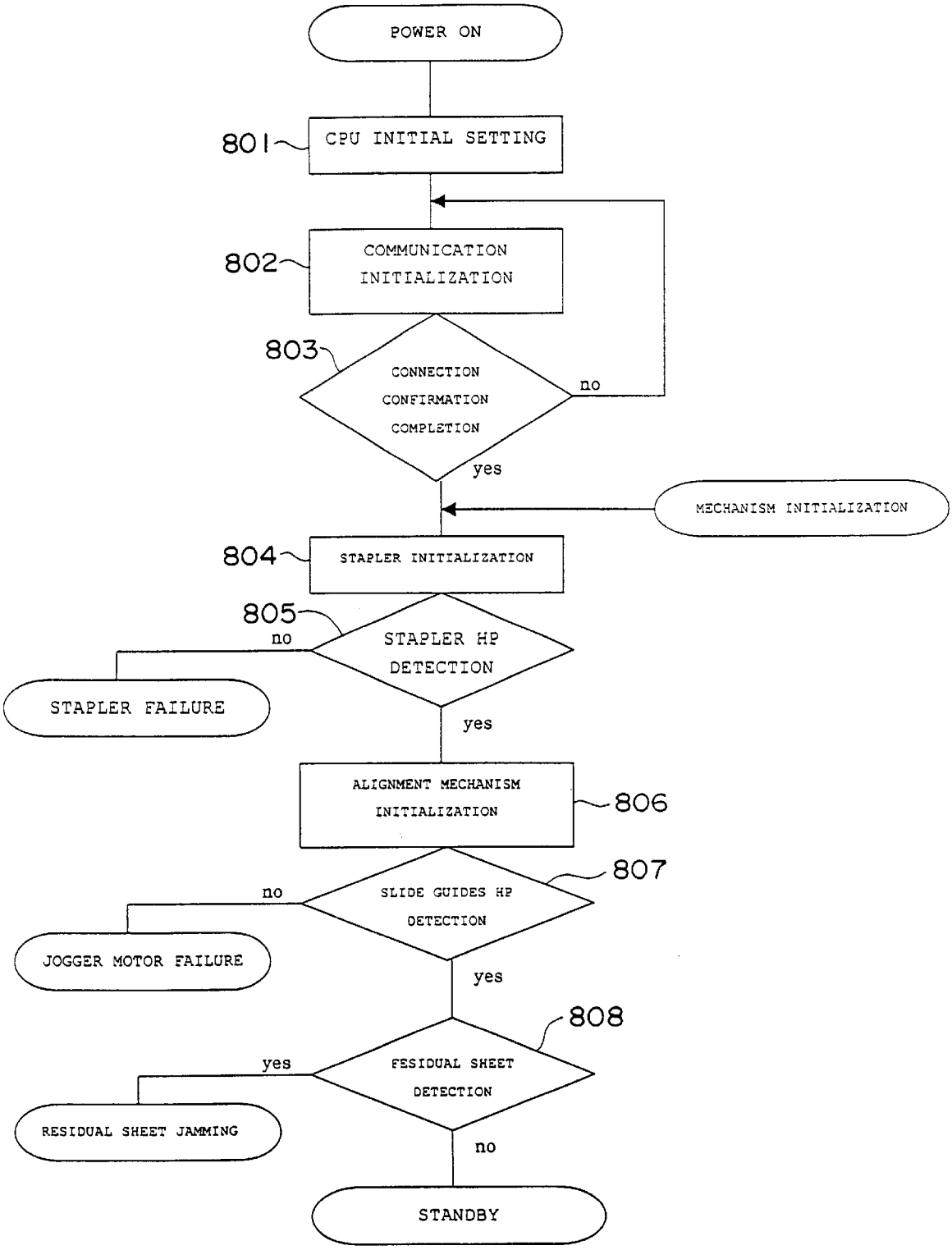
FIG. 8 is a flowchart showing an initializing operation in accordance with the first embodiment.

FIG. 8 is a flowchart showing an initializing operation of the sheet post-processing device 300.

First, the CPU 702 is initialized (S801). In this step, the setting of various specific registers such as a timer setting, an interruption setting, a serial communication setting and an I/O port setting is conducted.

In order to conduct the serial communication with the image controller 701, the CPU 702 cancels the communication interruption and waits for a command from the image controller 701. An initial command and a second command transmitted from the controller 701 are given codes. The number of optional devices connected to the printer main body 100 and the confirmation for connections are conducted by the initial command, the second command and a predetermined data (referred to as "status") code returned to the image controller 701 by the CPU 702 (S802 and S803).

Subsequently, the sheet post-processing device is initialized (S804 to S808).

First, the stapler H is initialized (S804). The stapler H has a staple cartridge sensor 704 not shown for predicting no staple and a stapler home position sensor 705 indicating that the clincher of the stapler is at an initial position. The initialization of the stapler H is completed by returning the clincher to the initial position. If the clincher is not at the initial position, the motor is rotated for a given period of time in a direction opposite to the rotating direction for normally stapling to return the clincher to the initial position.

Subsequently, it is judged whether the stapler home position sensor 705 could detect the clincher at the initial position, or not, and if the stapler home position sensor 705 could not detect the clincher at the initial position regardless of the stapler motor having been reversed for the given period of time, a stapler failure operation not shown is conducted (S805).

Then, a operation of returning the slide guides R310 and L311 to the initial position is conducted. The CPU 702 completes the initialization at the time where the jogger HP sensor detects the slide guide R310 and the slide guide L311 while rotating the jogger motor M in a direction where the slide guides R310 and L311 are opened by a given number of steps (S806).

Then, if the slide guides R310 and L311 cannot be detected although the jogger motor M is driven by the given number of steps, a jogger motor failure-operation not shown is conducted (S807). In the first embodiment, the jogger motor failure is judged on the basis of the given number of steps, but the same effect is obtained on the basis of the rotation for a given period of time.

Figure 13:
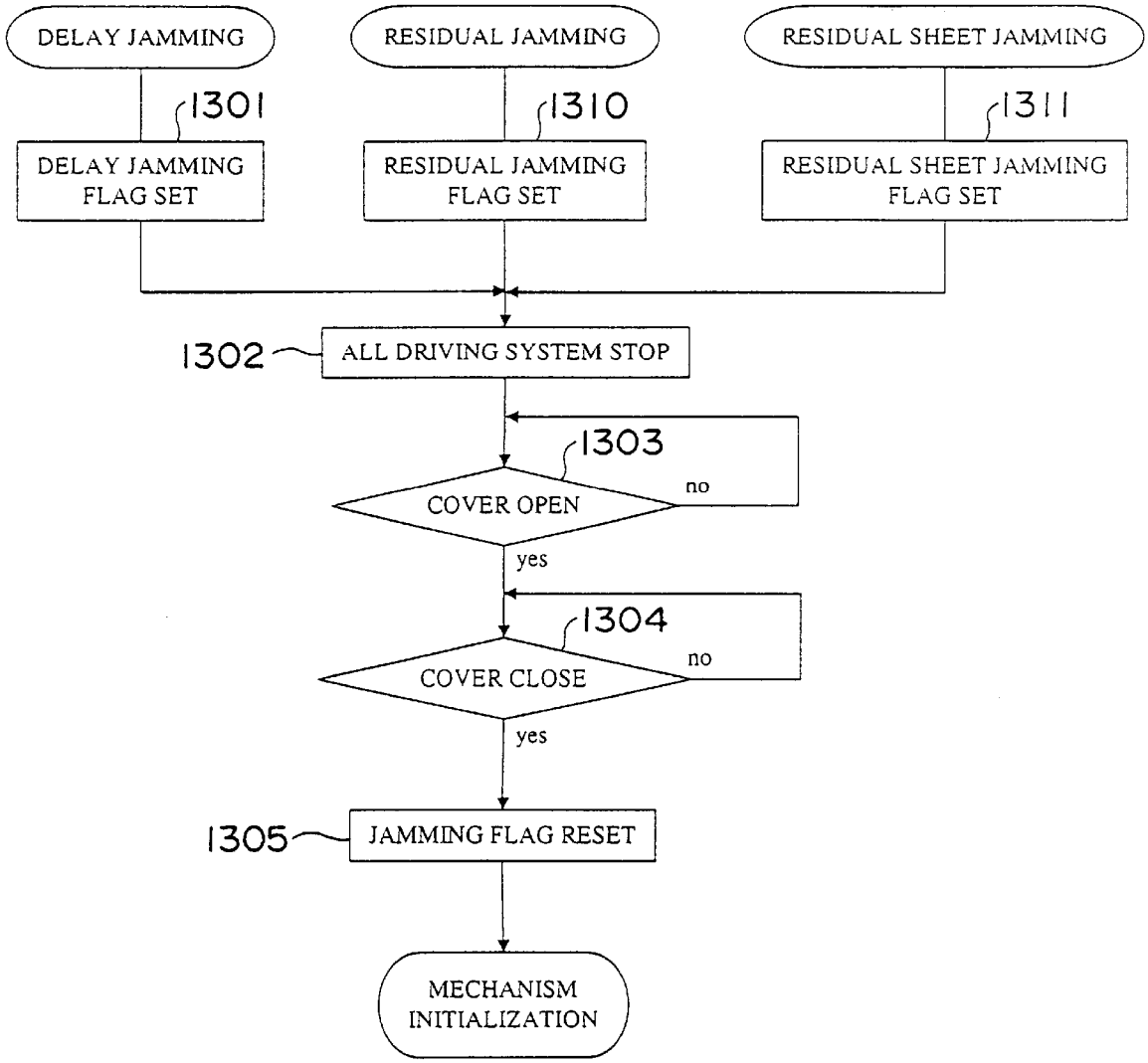
FIG. 13 is a flowchart showing a jam clearance operation in accordance with the first embodiment.

Then, the discharge sensor 321 detects the residual sheet within the sheet post-processing device 300, and if there exists a sheet, a jam clearance operation shown in FIG. 13 is conducted (S808). In the first embodiment, the residual sheet within the device is detected by only the sheet detection of the discharge sensor 321, but if the driving motor M1 is driven for a given period of time, and the presence/absence of the sheets is monitored by the discharge sensor during the period of time, a range where the residual sheets within the device can be detected can be widened. With the above operation, the initialization of the sheet post-processing device 300 is completed.

Figure 9:
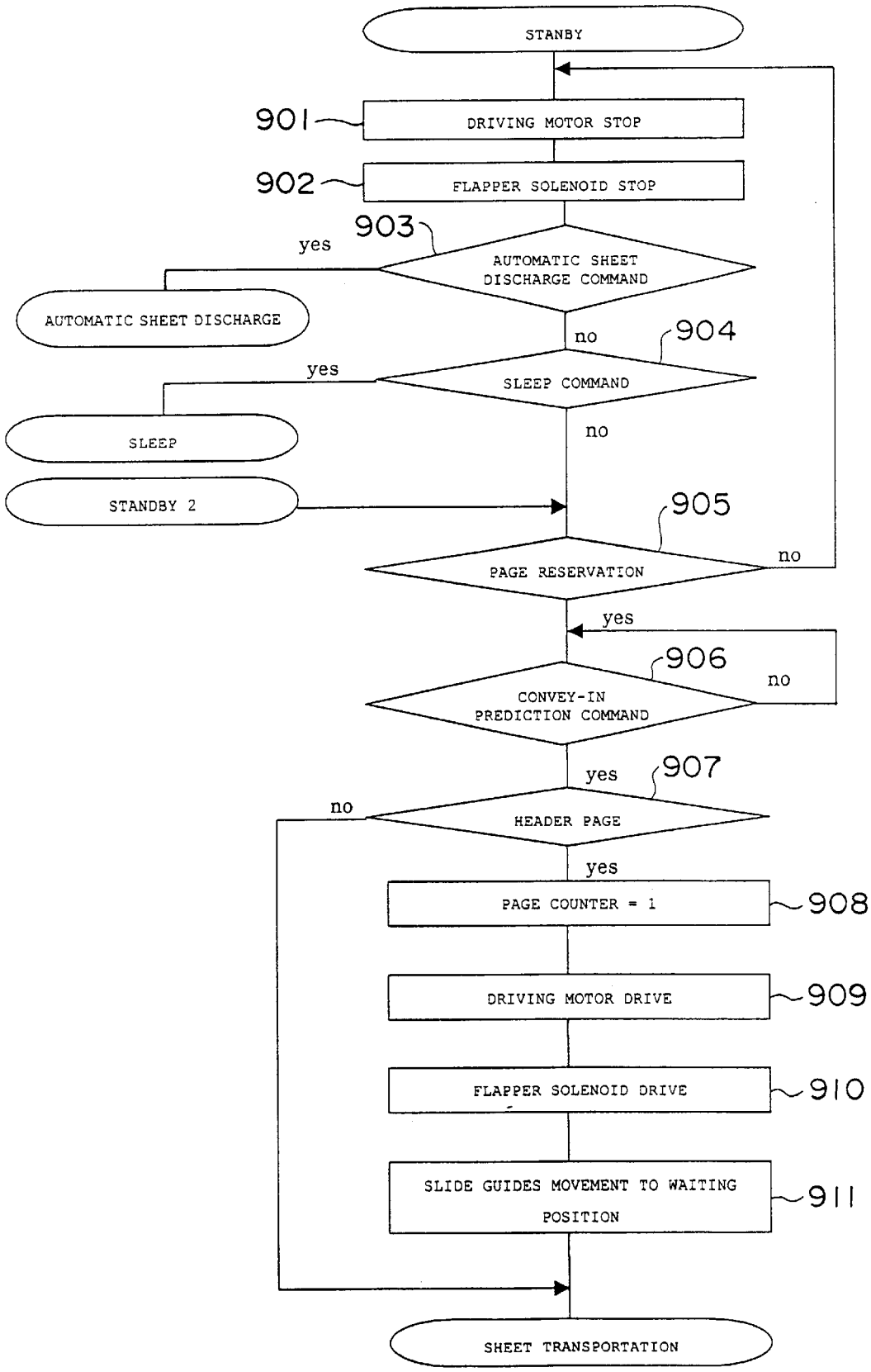
FIG. 9 is a flowchart showing a standby operation in accordance with the first embodiment.

FIG. 9 is a flowchart showing an operation in which the sheet post-processing device 300 is on standby.

When the sheet post-processing device 300 is on standby, there are mainly an operation for holding page information not shown which is transmitted from the image controller 701 and an operation for waiting for a sheet conveying-in prediction. The page information has the sheet size and operations for the page, and when the page information is decided, a latch command is sent to the CPU 702 from the image controller 701. For example, in case of a job of stapling 3 pages of A4-size sheets, the respective commands indicating "a size of A4"+"a job header"+"latch" in a first-page information are sent from the image controller 701 to the CPU 702, the respective commands indicating "a size of A4"+"latch" in a second-page information is sent from the image controller 701 to the CPU 702, and the respective commands indicating "a size of A4"+"job completion"+ "latch" in a third page information is sent from the image controller 701 to the CPU 702. Also, there is prepared a command that inquires an operating period of time between pages, and when the image controller 701 designates information of adjacent pages to the CPU 702 by commands, the CPU 702 informs the image controller 701 of a required period of time between the pages on the basis of the information.

In the above example, the operating period of time is 500 ms in case of the first page (the first page is designated in this case), 500 ms between the first page and the second page, and 500 ms between the second page and the third page. If a succeeding job is designated, the operating period of time is 6 seconds between the third page and a first page of the succeeding job. The period of time of 6 seconds is a period of time during which the sheet post-processing device 100 staples a bundle of sheets on the slide guides, drops down to the face-down discharge portion 125 of the printer main body, and then detects the amount of stacks which will be described later.

The standby operation first stops the driving motor M1 (S901), stops the flapper solenoid SL (S902) and then analyzes the command that can be processed during standby.

Figure 15:
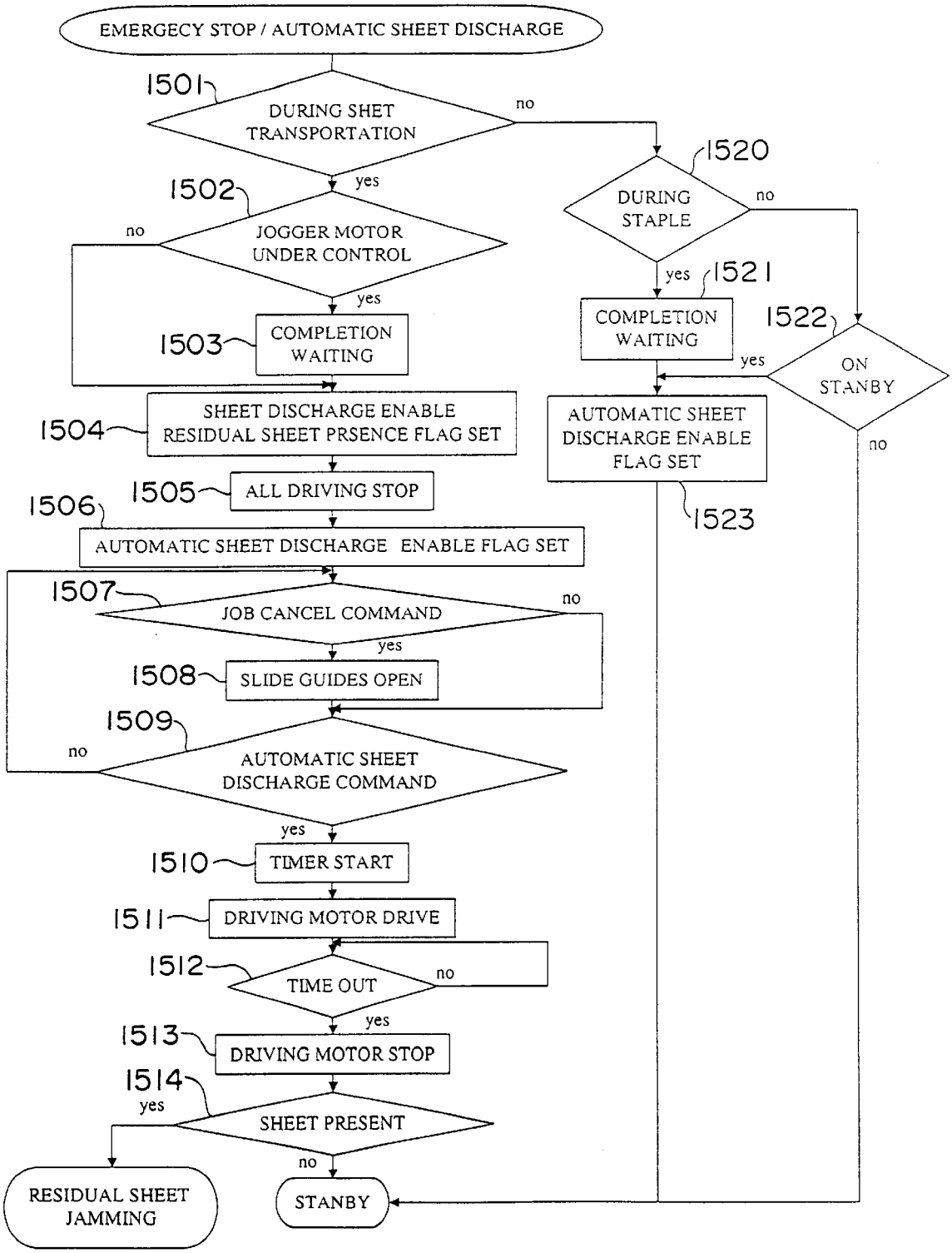
FIG. 15 is a flowchart showing an emergent stop and automatic sheet discharging operation in accordance with the first embodiment.

First, it is judged whether the automatic sheet discharge command is received from the image controller 701, or not, and if received, an automatic sheet discharge operation shown in FIG. 15 is conducted (S903).

Then, it is judged whether a sleep command is received from the image controller 701, or not, and it received, a sleep operation not shown is conducted (S904).

Then, it is judged whether at least one of the above-mentioned exemplified page information is registered (latched), or not, and if no page information is registered, the processing is returned to the operation of S901 (S905).

Then, it is judged whether a sheet convey-in prediction command with respect to the registered initial page information is received from the image controller 701, or not, and the CPU waits for the reception of the command (S906).

If the convey-in prediction command is received, it is first judged whether the page information corresponding to the convey-in prediction command is "page header", or not (S907). If it is the page header, the page counter of the job is initialized to 1 (S908), the driving motor M1 is driven (S909), the flapper solenoid SL is driven (S910) and the operation is shifted to the sheet transporting operation. In addition, the slide guides are moved to the sheet waiting position (S911).

Then, the jogger HP sensor is monitored, and when the slide guides are not moved from the initial positions although the jogger motor M is driven by the given number of steps, the jogger motor failure operation is conducted.

Figure 10:
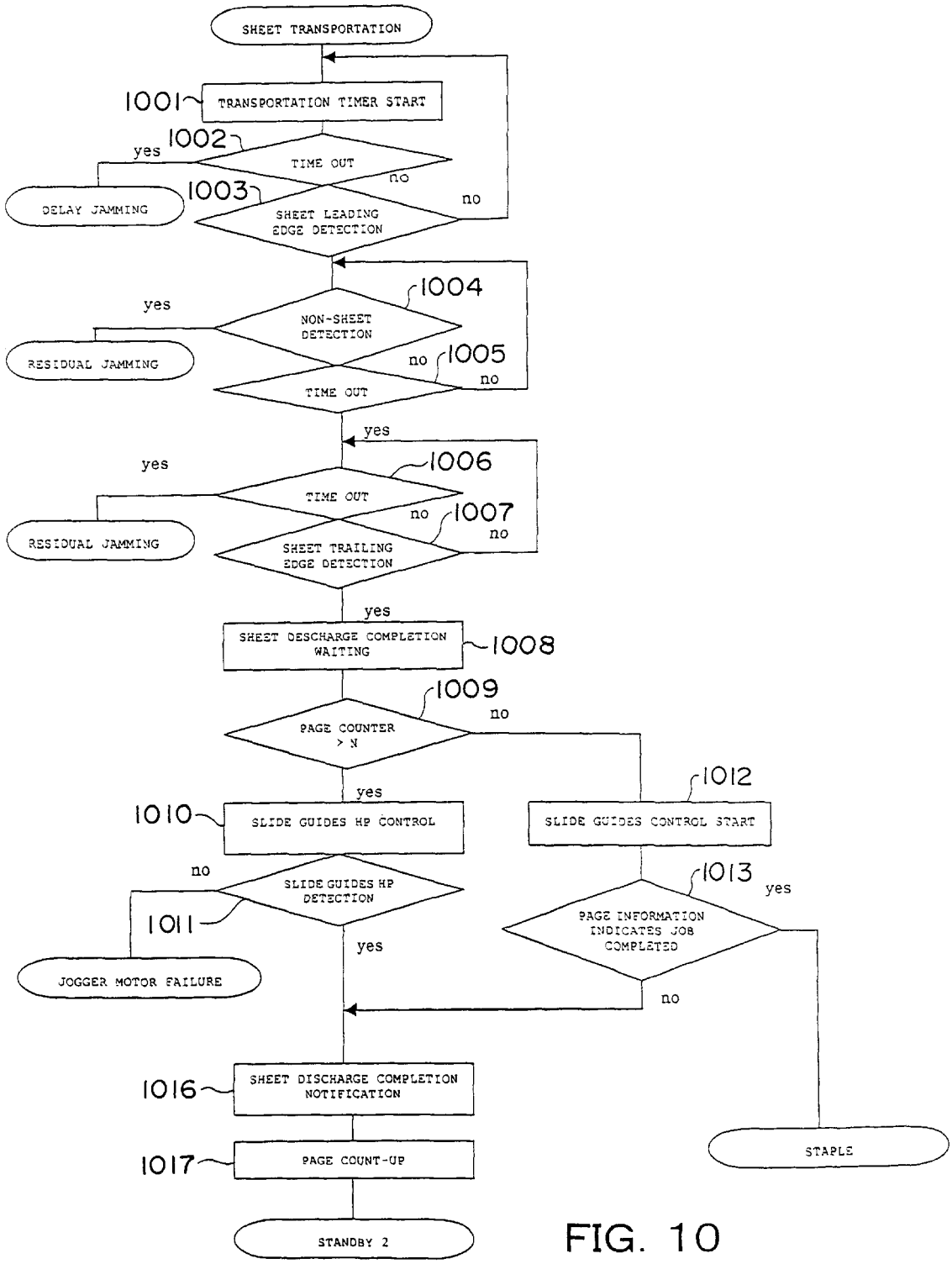
FIG. 10 is a flowchart showing a sheet transporting operation in accordance with the first embodiment.

FIG. 10 is a flowchart showing the sheet transporting operation of the sheet post-processing device 300.

First, the timer for the sheet transporting control is started (S1001).

Then, a sheet leading edge is detected by the discharge sensor 312, and if the sheet leading edge cannot be yet detected, it is judged by the timer whether a sheet delay jamming occurs, or not, and if a time is over, the jam clearance operation shown in FIG. 13 is conducted (S1002, S1003). In this situation, if the sheet leading edge is detected, the discharge sensor is again monitored, and it is confirmed that the sheets exist within a given period of time (S1004, S1005). If no sheet is detected during the given period of time, it is judged that some transportation abnormality occurs, and the jam clearance operation shown in FIG. 13 is conducted.

Then, a monitoring for detection of the sheet trailing edge is conducted by the discharge sensor 321, likewise.

It is judged whether the monitoring period is over, or not, and if the time is over, it is judged that the residual jamming occurs, and the jam clearance operation of FIG. 13 is conducted (S1006, S1007). If the sheet trailing edge is detected in S1006, the CPU waits for the elapse of a given period of time (S1008).

Then, it is judged whether a value of the page counter is a given number N+1 or more, or not (S1009). If it is N+1 or more, because there is the possibility that the sheet post-processing device 100 cannot staple the sheets, the slide guides are returned to the initial position (S1010).

Then, similarly to the initializing operation, it is confirmed whether the slide guides are returned to the initial position, or not, and if not returned, a jogger motor failure operation not shown is conducted (S1011). If the number of sheets is within N, the jogger motor is rotated to align the sheets (S1012). The amount of movement of the slide guides for aligning the sheets, and so on are identical with those described with reference to FIGS. 4A, 4B, 5A and 5B.

It is judged whether the page information is "job completion", or not (S1013), and if the job is completed, the operation is shifted to the stapling operation. If not, the CPU 702 notifies the image controller 701 of the discharge completion (S1016), the page counter is counted up in S1017, and the operation is returned to the operation of S905.

Figure 11:
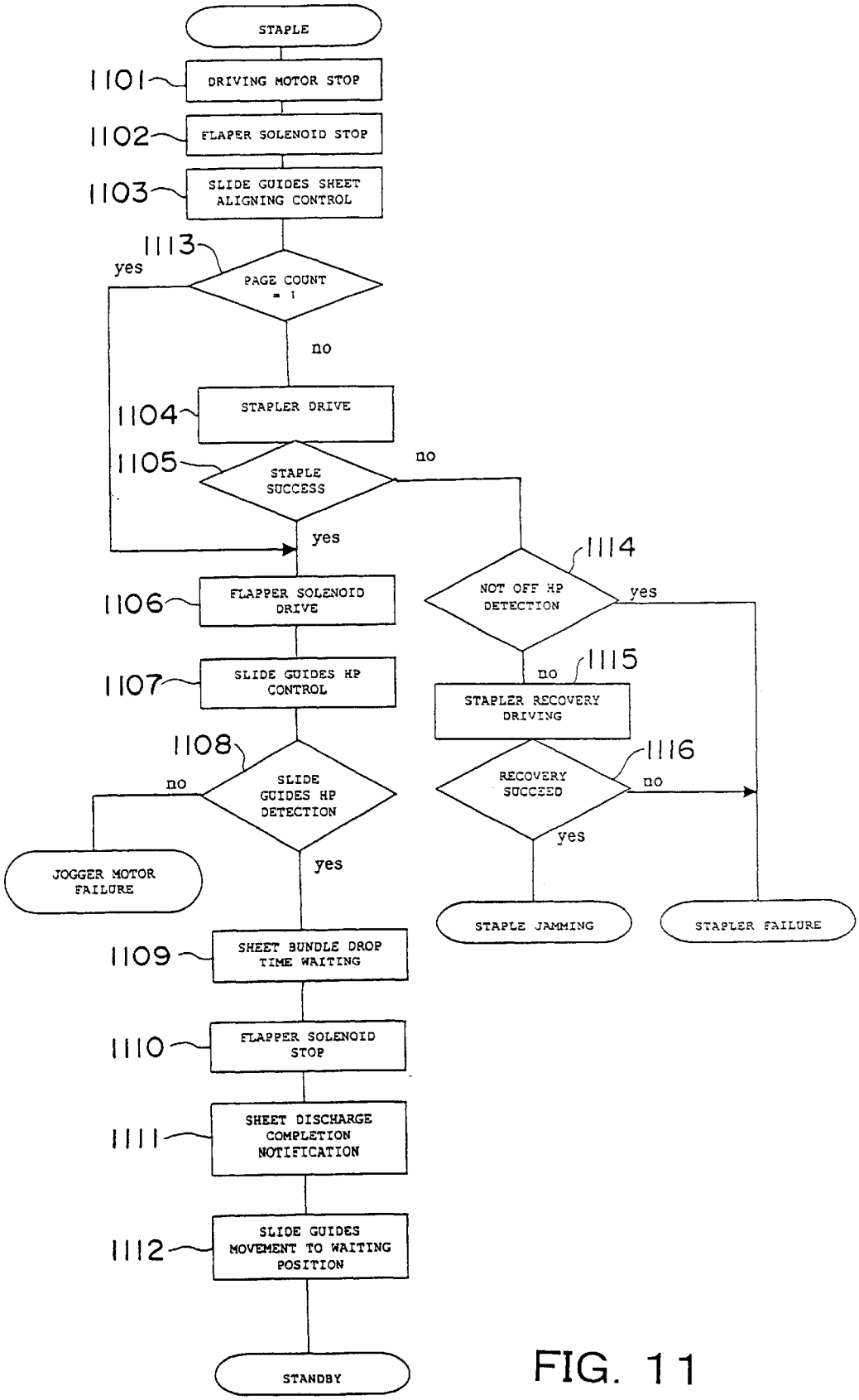
FIG. 11 is a flowchart showing a stapling operation in accordance with the first embodiment.

FIG. 11 is a flowchart showing the stapling operation.

First, the driving motor M1 is stopped (S1101), and the flapper solenoid SL is stopped (S1102).

Then, the bundle of sheets due to the slide guides for the stapling operation is aligned (S1103). Upon the completion of the sheet aligning operation, it is judged whether the page counter is 1, or not (S1113). If the page counter is 1, the operation of S1106 is conducted without stapling. If the page counter is not 1, the stapler motor is driven (S1104) to start the operation of the stapling operation.

Then, the staple cartridge sensor 704 is monitored, and it is judged whether the staple motor correctly operates by moving the clincher of the stapler from the initial position, or not (S1105), and if the staple cartridge sensor 704 continues to detect the clincher at the initial position for a given period of time, a stapler motor failure operation not shown is conducted. Also, when the stapling operation is correctly conducted, since the staple cartridge sensor 704 again detects that the clincher is returned to the initial position after the given period of time, if the clincher at the initial position cannot be detected for the given period of time, the stapler motor failure operation not shown is conducted.

If the stapler motor does not fail, the flapper solenoid SL is then driven (S1106), and the slide guides are moved to the initial position (S1107). In this situation, similarly to the initialization, it is judged whether the slide guides are returned to the initial position, or not (S1108), and if not, the jogger motor failure operation not shown is conducted. When the slide guides are moved to the initial position, the bundle of sheets stapled on the slide guides drop down on the face-down discharge portion 125 of the printer main body 100.

In this situation, a drop period waiting operation is conducted (S1109). After the bundle of sheets has dropped down, the flapper solenoid stops (S1110), the discharge completion is notified the image controller 701 of (S1111), and the stapling operation is completed. Then, the slide guides move to the waiting position (S1112).

In the first embodiment, in the operation of stapling L sheets, at the point in time when a sheet of first to (L−1)th page is respectively stacked on the slide guides, the discharge completion is notified the image controller of, but the discharge completion of a sheet of L-th page is notified the image controller of at the point in time when the stapling operation has been completed. If a job is for one page or (N+1) pages or more, the stapling operation is not conducted.

The detailed judgment of the stapler failure is conducted in S1114 where a failure that the stapler does not operate although the stapler motor is driven is judged.

When the stapler operates but is not returned to the initial position, a motor reversing operation is conducted for a given period of time assuming that staples are jammed in S1115.

Figure 14:
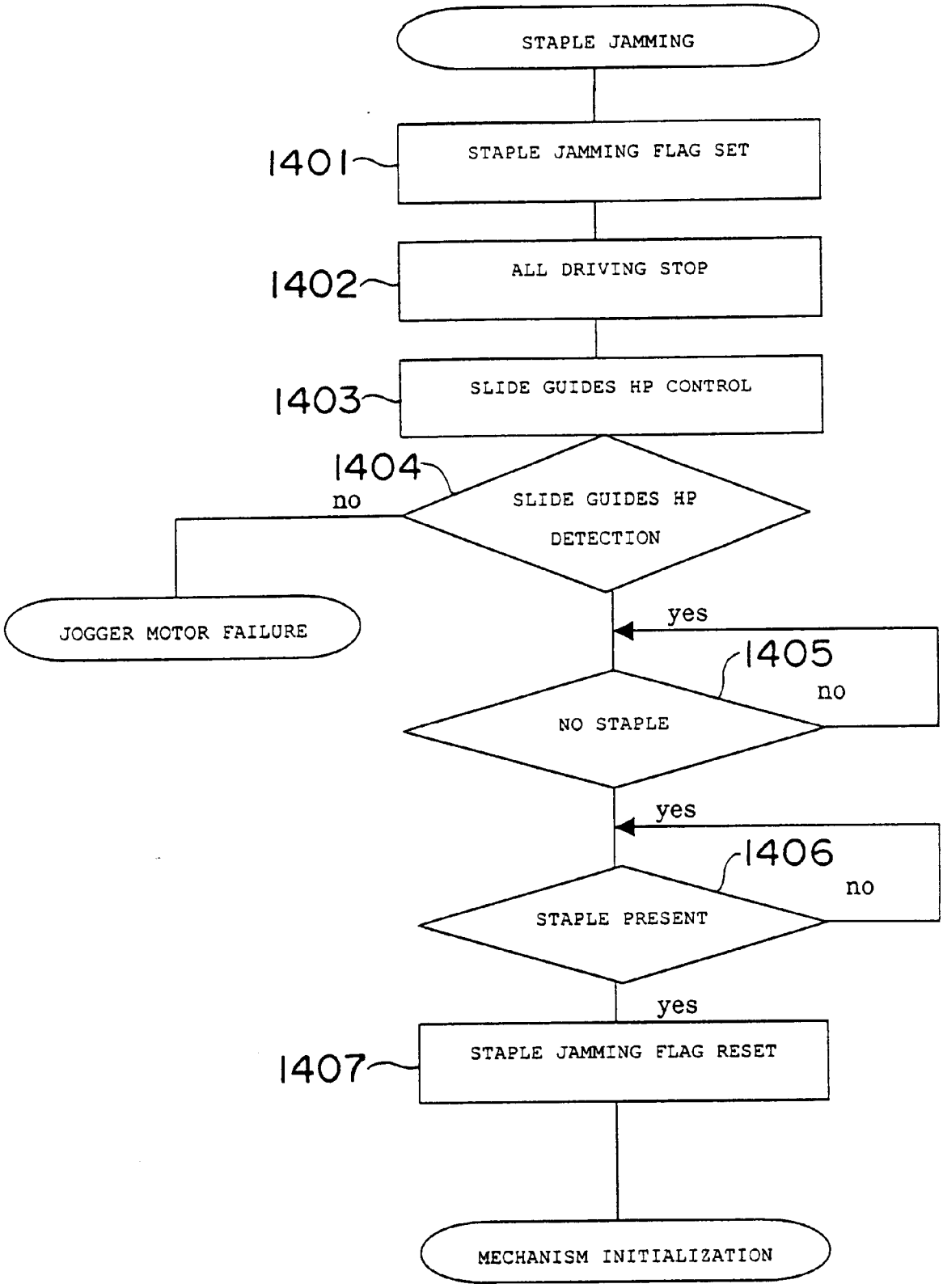
FIG. 14 is a flowchart showing a staple jam clearance operation in accordance with the first embodiment.

If this recovery operation is successful (S1116), since the stapler failure does not occur, a staple jam clearance operation shown in FIG. 14 is conducted.

Figure 12:
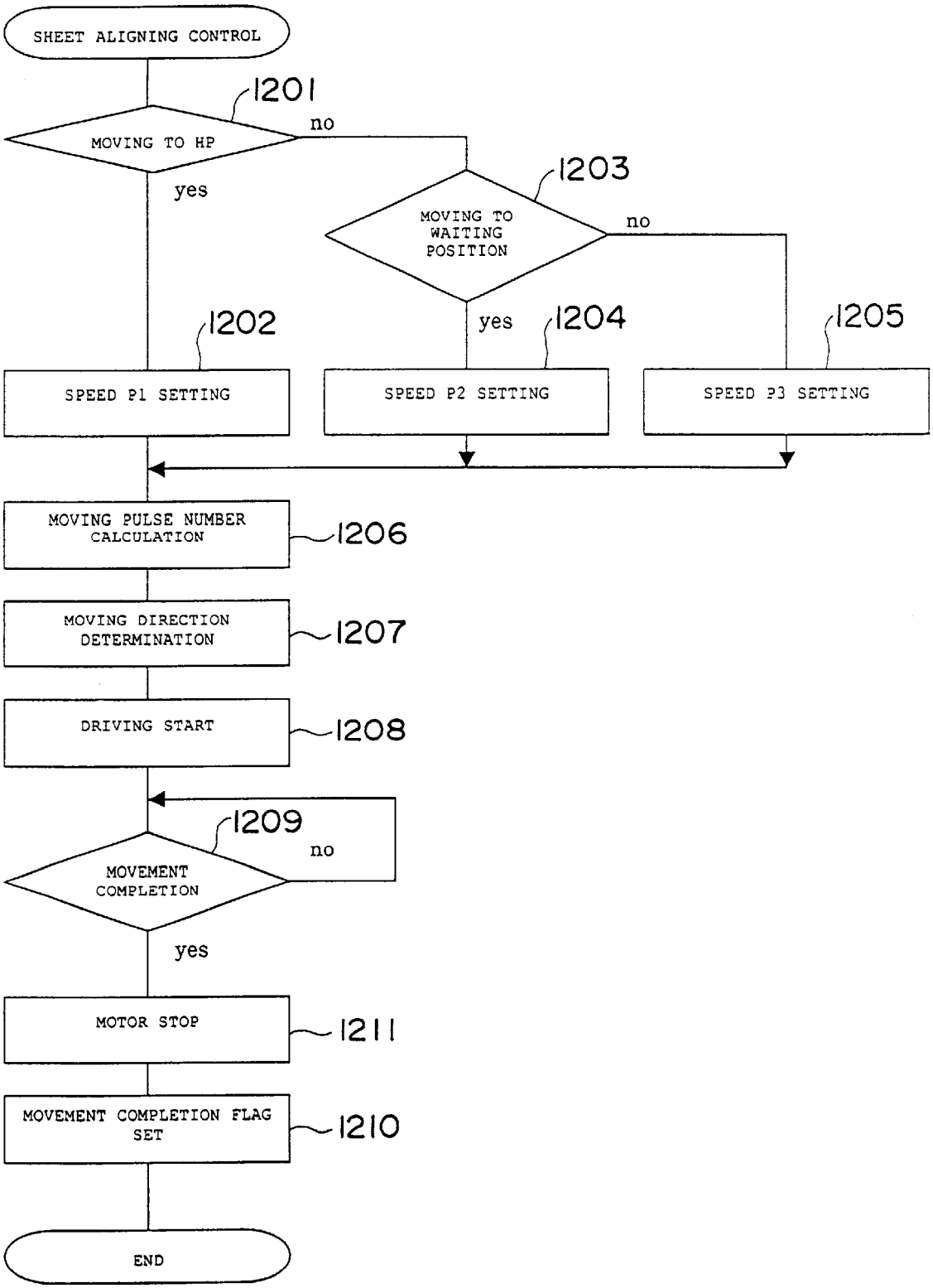
FIG. 12 is a flowchart showing a aligning operation in accordance with the first embodiment.

FIG. 12 is a flowchart showing the control operation of the jogger motor M.

In the jogger motor control operation, a operation mode and a moving position are designated the above-mentioned initializing operation, the sheet transporting operation and the stapling operation, so that the jogger motor operates correspondingly and that the slide guides move to a desired position. If the control is normally completed, a normal operation flag is set when the operation is completed, and the operation completion is notified the respective operations that request the operation of. The moving position is represented by an absolute position with setting the initial position of the slide guides to 0, and a moving direction is found out from the current position and a position to be moved.

First, it is judged which operation mode should be conducted (S1201, S1203). If the movement of the slide guides to the initial position is designated in Step S1201, a moving speed P1 is set (S1202), but if the movement of the slide guides to the waiting position for aligning the sheets is designated in Step S1203, a moving speed P2 is set (S1204), and if not so, a moving speed P3 is set as a movement at the time of aligning the sheets (S1205). In this example, the moving speeds P1, P2 and P3 have the following relationship. That is, P1>P2>P3 is satisfied, and in particular, the speed P1 is an important speed for regularly dropping down the bundle of sheets to the face-down discharge portion 125 of the printer main body 100 from the slide guides 310 and 311, and a speed of 50 mm/sec or higher.

Subsequently, the number of movement pulses is calculated on the basis of the current position and a designated position (S1206), and a moving direction is determined on the basis of the calculated information (S1207) Then, the jogger motor starts to be driven (S1208), and it is judged whether a given number of pulses are driven, or not (S1209) The addition and subtraction of the number of pulses and a change-over of an exiting phase are conducted by a timer interrupting operation not shown, Then, the motor stops (S1211), and a normal completion flag is set to complete the operation (S1210).

FIG. 13 is a flowchart showing the jam clearance operation of the sheet post-processing device.

In the case where the sheet delay jamming is detected by the sheet transporting operation, the delay jamming flag is set (S1301), and the sheet delay jamming is notified the image controller 701 of. In case of the sheet residual jamming, the residual jamming flag is set (S1310), and the sheet residual jamming is notified the image controller 701 of. In the case where the residual sheets within the device are detected by the initializing operation, the residual sheet jamming flag is set (S1311) and the sheet residual jamming is notified the image controller 701 of.

Then, after setting those flags, all the driving stops (S1302). Then, the CPU waits for the opening of the cover by an operator (S1303). If the cover is opened, the CPU then waits for the closing of the cover by the operator (S1304).

Then, the jamming flag is reset (S1305), and this is informed the image controller 701 of, and the operation is shifted to the operation of initializing the sheet post-processing device. This operation assumes that the operator removes the jammed sheets while the cover opens or closes. However, even if the jammed sheets are not removed, the in-device residual sheets are detected through the initializing operation, and this can be informed the image controller of. Also, even if jamming occurs during the stapling operation or the slide guides movement, those driven systems can be moved to the initial position through the initializing operation.

FIG. 14 is a flowchart showing a operation when a staple of the stapler is jammed.

First, the staple jamming flag is set (S1401), and this is notified the image controller 701 of, and all of the driving systems stop at the same time (S1402).

Then, the operator opens the slide guides so as to readily conduct the staple jam clearance operation (S1403). Even in this situation, similarly to the initializing operation, it is monitored whether the slide guides are returned to the initial position, or not, and if not returned, the jogger motor failure operation not shown is conducted (S1404). After the slide guides are returned to the initial position, it is confirmed that the staple cartridge is removed by the operator (S1405), and that the staple cartridge is set (S1406) and the staple jamming flag is reset (S1407), and this is notified the image controller 701 of. This assumes the operation of removing the abnormal staple within the staple cartridge by the operator.

FIG. 15 is a flowchart showing the emergent stop and the automatic sheet discharging operation of the sheet post-processing device 300.

In the case where a troublesomeness such as jamming occurs within the printer main body 100 while the sheet post-processing device 300 transporting the sheets or being on standby, the image controller 701 transmits an emergent stop command to the CPU 702.

In this situation, it is judged whether the sheet post-processing device 300 is transporting the sheets, or not (S1501), and if the sheet post-processing device 300 is transporting the sheets, it is judged whether the slide guides are controlled, or not (S1502). If the slide guides are controlled, the CPU waits for the completion of this operation in Step S1503. In this case, since there is the possibility that the sheets remain on the slide guides or the transporting path, a flag that indicates that there exist the discharge enable residual sheets is set, and this is notified the image controller 701 of.

Then, all of the driving systems stops again (S1505), the automatic sheet discharging operation enable flag is set (S1506), and this is notified the image controller 701 of. In this situation, the CPU waits for a succeeding operation command from the image controller 701, but when receiving a job cancel command (S1507), the slide guides are returned to the initial position so as to cancel the job that is being processed at present (S1508), and the bundle of sheets on the slide guides are allowed to drop down on the face-down discharge portion 125 of the printer main body 100, if no cancel command is received, the job can be continued after the troublesomeness of the main body has been released.

Then, it is judged whether the automatic sheet discharge command is received, or not (S1509), and if not received, the operation of Step 1507 and the subsequent steps are repeated. If the automatic sheet discharge command is received, the timer for the automatic sheet discharging operation starts (S1510), the driving motor M1 is driven (S1511) and the sheets that are being transported are transported up to the slide guides. In this operation, the flapper solenoid SL is not allowed to operate. The sheets that remain within the sheet post-processing device in the operation of the emergent stop operation are clearly sheets that are being subjected to the stapling operation, which is a part of job. However, since other sheets, for example, the sheets that remain in the printer main body 100 are recovered by the image controller 701 later, they are unnecessary for the job. Therefore, by not operating the flapper solenoid SL the unnecessary sheets can be discharged onto the face-down discharge portion 125 of the printer main body 100.

After the driving motor M1 has been driven for a given period of time (S1512), the driving motor M1 stops (S1513) Then, it is confirmed by the discharge sensor 321 whether the sheets are discharged, or not (S1514), and if the sheets are detected, the jam clearance operation of FIG. 13 is conducted as a discharge disenable in-device residual sheet jamming. If the automatic sheet discharge is completed, the operation is returned to the standby operation. If the sheets are not being transported in Step S1501, it is judged whether the stapling operation is being conducted, or not (S1520). If the stapling operation is being conducted, the job is going to be completed, and the CPU waits for the completion of the stapling operation without interrupting the operation (S1521).

After the completion of the stapling operation, the automatic sheet discharge enable flag is set (S1523), to thereby complete the emergent stop operation. In this case, since no sheets exist within the sheet post-processing device, even if the automatic sheet discharge command is received, it is unnecessary to conduct the automatic sheet discharging operation. If the stapling operation is not being conducted in Step S1520, it is judged whether it is on standby, or not (S1522). If it is on standby, the operation of S1523 is conducted. Similarly, in this case, even if the automatic sheet discharge command is received, it is unnecessary to conduct the automatic sheet discharging operation. If it is not on standby in Step S1522, since it is in the initial state or in the abnormal state, the automatic sheet discharge enable flag is not set.

The above description is given of the first embodiment, however, according to the present invention, in the image forming apparatus that discharges the sheets onto the upper surface of the apparatus, the sheet post-processing device having at least the stapler is disposed above the discharge portion on the upper surface of the apparatus main body. Then, since the sheet post-processing device is so structured as to drop down the sheets that have been subjected to post-processing by the sheet post-processing device on the discharge portion of the apparatus main body side which is located below so as to stack the sheets, the simplification and a reduction of the costs of the sheet post-processing device can be realized.

In the first embodiment, the stapling means is described as the sheet post-processing means, but the same effects are obtained if the sheet post-processing with the sheet aligning operation is conducted, for example, even if a punching means that opens a punch hole in a bundle of sheets, a book binding means having a sheet folding means after the sheets have been stapled, a book binding means that adhering the edges of sheets, or other easy binding means is employed.

(Second Embodiment)

In a sheet post-processing device according to a second embodiment, there is provided a measuring means that counts the number of sheets stacked on a first sheet stacking portion. If a comparing means that compares the number of sheets M that has been counted by the measuring means with a stapling permissible number of sheets (post-processing permissible number of sheets) N detects that a relationship of M>N is satisfied, the slide guides are opened without conducting the sheet post-processing, and a bundle of sheets are allowed to drop down on the face-down discharge portion 125 of the printer main body 100. Note that the measuring means may adopt a method of mechanically counting the number of sheets as well as a method of calculating the number of sheets by, for example, mechanically and optically detecting the thickness of the bundle of sheets, or detecting the weight of the bundle of sheets.

Also, if a bundle of sheets stacked on the first sheet stacking portion are aligned by operating only the sheet aligning means and thereafter allowed to drop down on the face-down discharge portion 125, the sheets are regularly discharged to the face-down discharge portion 125, thereby making it possible to readily collect the bundle of sheets.

As a result, the sheets that have already been stacked on the first sheet stacking portion can be simply stacked on the face-down discharge portion 125 in a short period of time, and the processing can be implemented under simple control without increasing the costs in the case where a job for sheets the number of which exceeds the post-processing permissible number is designated.

Also, if it is judged that the relationship of M>N is satisfied in the above comparing means, when a command for binding the bundle of sheets from the image forming apparatus is accompanied with an (M+1)th sheet or the subsequent sheet, not only the bundle of sheets that have been already stacked on the first sheet stacking portion, but also the (M+1)th sheet and the subsequent sheets are further conveyed into the first sheet stacking portion of the sheet discharge device from the image forming apparatus. In this case, the control can be as follows: the bundle of sheets that have been already stacked on the first sheet stacking portion are allowed to drop down on the face-down discharge portion 125 of the printer main body 100 by opening the slide guides as described above, and thereafter the sheets that have been conveyed in the first sheet stacking portion can be allowed to drop down on the face-down discharge portion 125 that functions as a second sheet stacking portion for each of the sheets without being stacked on the first sheet stacking portion and also being subjected to post-processing.

As a result, the sheets that have already been stacked on the first sheet stacking portion can be simply stacked on the face-down discharge portion 125 in a short period of time, and the processing can be implemented under simple control without increasing the costs in the case where a job for sheets the number of which exceeds the post-processing permissible number is designated.

In the above-mentioned embodiment, if it is judged that the sheets of the number that exceed the stapling permissible number of sheets N are stacked on the slide guides 310 and 311, the slide guides are opened, and the bundle of sheets are allowed to drop down on the face-down discharge portion 125 that functions as the second sheet stacking portion of the printer main body 100. The subsequent sheets are not set and they are stacked on the face-down discharge portion 125 of the printer main body 100 sheet by sheet in the same way. Since those sheets are not stapled, it is more preferable that the error handling operation can be conducted without transporting the sheets to the sheet post-processing device 30.

In this example, in the case where the above comparing means judges that the relationship of M>N is satisfied, if the sheet bundle binding command from the image forming apparatus is accompanied with an (M+1)th sheet or the subsequent sheet, not only the bundle of sheets that have been already stacked on the first sheet stacking portion but also the (M+1)th sheet and the subsequent sheets are conveyed in the first sheet stacking portion of the sheet post-processing device from the image forming apparatus.

In this case, the control may be conducted as follows. That is, the bundle of sheets that have been already stacked on the first sheet stacking portion are allowed to drop down on the face-down discharge portion 125 of the printer main body 100 by opening the slide guides as described above, and thereafter the flapper solenoid SL that functions as the sheet discharge path change-over means is turned off, to thereby stack the subsequent sheets directly on the face-down discharge portion 125 of the printer main body 100 sheet by sheet without being stacked on the first sheet stacking portion of the sheet post-processing device 300.

As a result, because the (M+1)th or subsequent sheets are stacked directly onto the face-down discharge portion without being stacked on the first sheet stacking portion, and the processing is completed in a shorter period of time, and the processing is implemented under simple control without increasing the costs in the case where a job for sheets the number of which exceeds the post-processing permissible number is designated.

Figure 16:
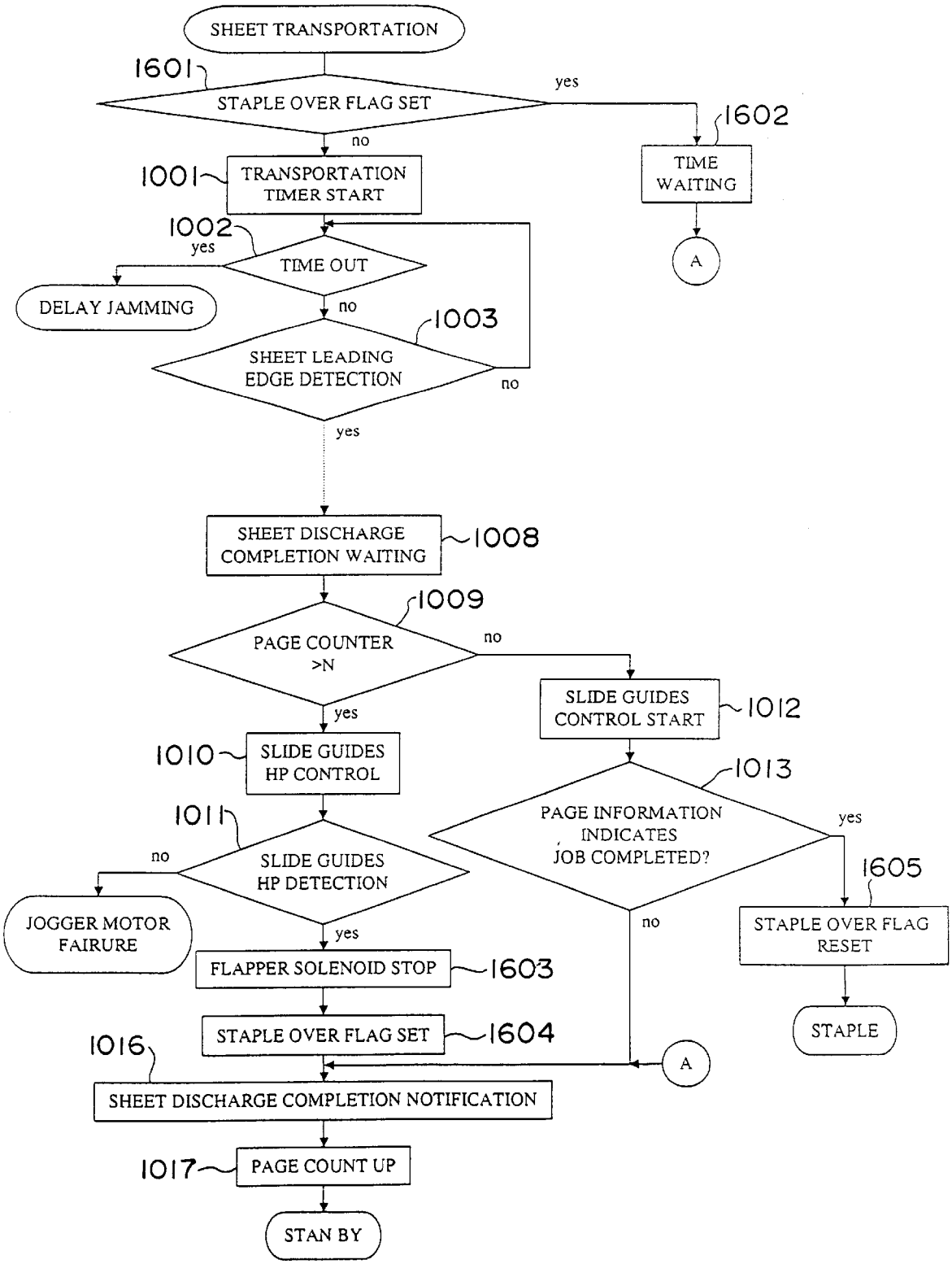
FIG. 16 is a flowchart showing a sheet transporting operation in accordance with a second embodiment.

FIG. 16 shows a sheet transporting operation in accordance with the second embodiment. The contents of the operation are substantially identical with the operation shown in the chart of FIG. 10, but there are added an operation of turning off the flapper solenoid SL in Step S1603 while the operation of Steps S1011 and S1016 is conducted, and a step of setting a flag that indicates that the staple over operation of Step S1604 is conducted. This flag is judged in an initial step S1601 of the sheet transporting operation, and if the flag is not set, the normal stacking operation is conducted. However, if the flag is set, after waiting time in step S1602, the control is skipped to the operation of Step S1016. The waiting time is identical with a period of time required until the sheets are stacked on the slide guides.

Also, a set flag indicating that the staple over operation is conducted is reset after the page information of the subsequent job indicates the header page (an operation of S907 in FIG. 9) although not shown. The above control is conducted, thereby making it possible to regularly discharge the sheets that have not been stapled to the face-down discharge portion 125 of the printer main body 100.

There may be a sheet post-processing device that is long in the transporting path or deals with the sheets of a small size. In this situation, when it is judged that the number of sheets M counted by the discharge sensor 321 exceeds the stapling permissible number of sheets N, there is a case where a plurality of sheets have been already transported to the sheet post-processing device. In this case, the control may be conducted as follows. It is assumed that the number of sheets that have been already transported into the post-processing device is X. In this case, even in the case where the comparing means judges that the relationship of M+X>N is satisfied, when the sheets that receives the sheet bundle binding command from the image forming apparatus is (M+X+1)th sheet or the subsequent sheet, after the sheets that have been already transported in the post-processing device in addition to the bundle of sheets that have been already stacked on the first sheet stacking portion are stacked on the first sheet stacking portion, the slide guides are opened as described above, and the bundle of sheets are allowed to drop down on the face-down discharge portion 125 of the printer main body 100. Thereafter, the flapper solenoid SL that functions as the sheet transporting path changing means is turned off to stack the subsequent sheets not an the sheet post-processing device 300, but directly on the face-down discharge portion 125 of the printer main body 100 sheet by sheet.

As a result, (M+X+1)th or the subsequent sheets are not transported to the post-processing device but stacked directly on the face-down discharge portion 125. Thus, because the processing is completed in a shorter period of time, the processing is implemented under simple control without increasing the costs in the case where a job for sheets the number of which exceeds the post-processing permissible number is designated.

In this case, if control is conducted such that the sheets for which the convey-in prediction commands are receipt are discharged from the sheet post-processing device, the remaining sheets are discharged onto the face-down discharge portion 125 of the printer main body 100 up to the sheet for a page of page end information, the same effects as those in the above-mentioned second embodiment can be obtained.

(Third Embodiment)

In the second embodiment, at the point in time when it is judged that the sheets of the number that exceeds the stapling permissible number of sheets N are stacked on the slide guides 310 and 311, the slide guides are opened, and the bundle of sheets are allowed to drop down on the face-down discharge portion 125 of the printer main body 100. Then, the subsequent sheets are stacked on the face-down (FD) discharge portion of the printer main body 100 sheet by sheet in the same manner without aligning the sheets.

However, in the case where the heights of the slide guides with respect to the face-down discharge portion 125 of the printer main body 100 are relatively higher, or in the case where the weight of sheets is light, when the sheets are allowed to drop down sheet by sheet, there is a case in which the stacking property of the face-down discharge portion 125 of the printer main body 100 is degraded.

Therefore, in the sheet post-processing device according to the third embodiment, there is provided a measuring means that counts the number of sheets stacked on the first sheet stacking portion, and even after a comparing means that compares the number of sheets M counted by the measuring means with a stapling permissible number of sheets (post-processing permissible number of sheets) N detects that the relationship of M>N is satisfied, when the sheet bundle binding command from the image forming apparatus is accompanied with an (M+1)th or subsequent sheet, the slide guides are opened and the bundle of sheets that have been already stacked on the fist sheet stacking portion are allowed to drop down on the face-down discharge portion 125 of the printer main body 100. Thereafter, the sheets transported to the first sheet stacking portion are stacked on the slide guides as in the normal operation once, and at the point in time when a given number of sheets are stacked on the first sheet stacking portion, the bundle of sheets are allowed to drop down on the face-down discharge portion 125 of the printer main body 100 without being stapled likewise, and subsequently the operation is repeated until the job is completed. Since the bundle of sheets are allowed to drop down at the point in time when a given number of sheets are thus stacked, the stacking property of the sheets on the face-down discharge portion 125 becomes satisfactory.

As a result, the processing is implemented under simple control without increasing the costs in the case where a job for sheets number of which exceeds the post-processing permissible number is designated.

In this situation, the given number of sheets is a value stored in the CPU 702 in advance although it may be arbitrary. Also, an interval between a final page of the given number of sheets and a first page of the succeeding given number of sheets is notified the image controller 701 of so as to provide a given period of time. Since the image controller 701 inquires of the CPU 702 a period of time between the respective pages at a timing where the page information transmitted for each of pages is transmitted to the CPU 702 from the image controller 701, the above notification replies to the image controller 701 at that timing.

As a result, it is possible to prevent the sheets from being newly transported on the first sheet stacking portion before a given number of sheets drop down.

Figure 17:
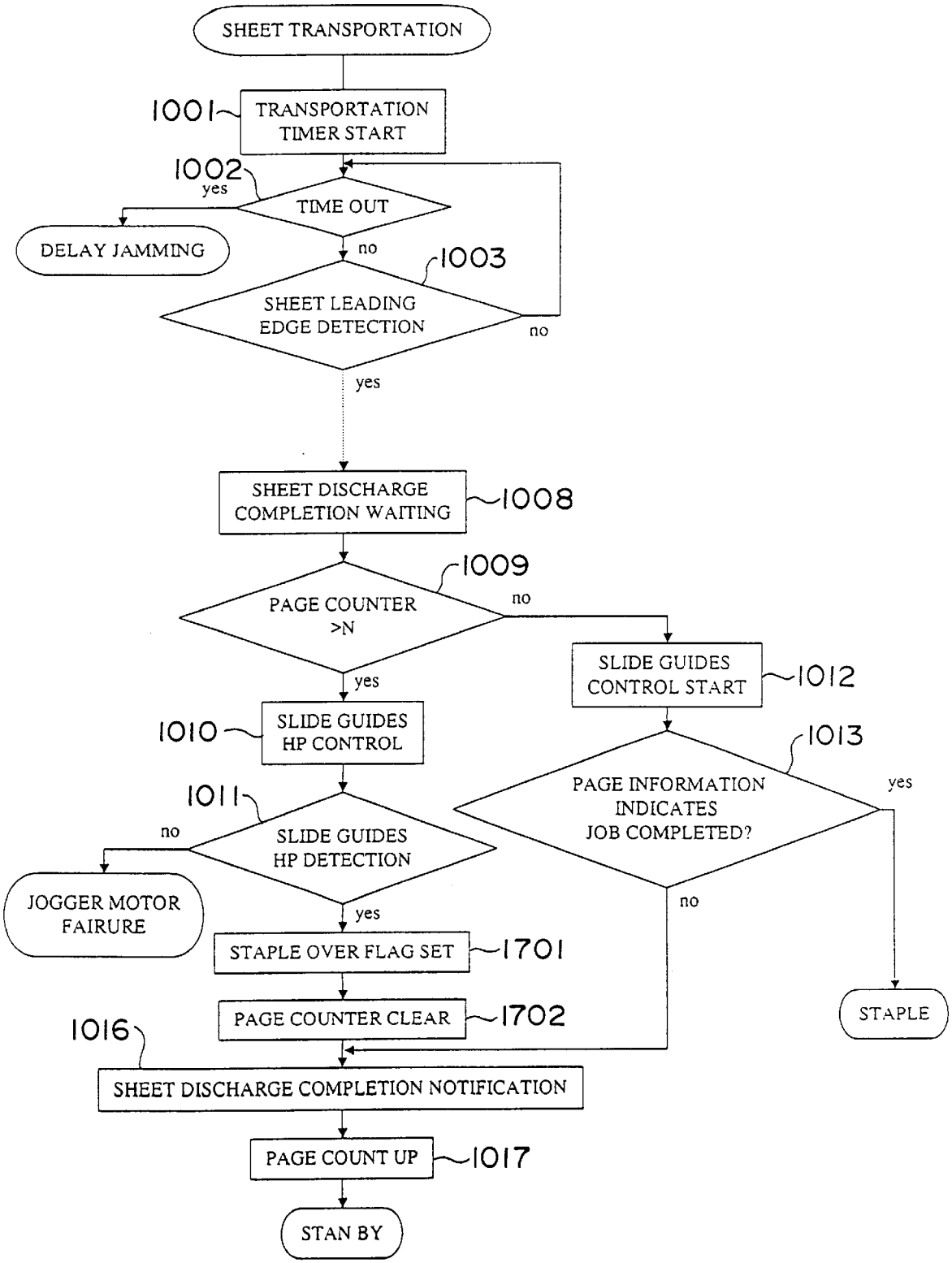
FIG. 17 is a flowchart showing a sheet transporting operation in accordance with a third embodiment.

FIG. 17 shows the sheet transporting operation in accordance with the third embodiment. The contents of the operation are substantially identical with the operation shown in the flowchart of FIG. 10, except the following operation. That is, after the slide guides are opened in Step S1010, and its confirmation is conducted, a flag indicating that the staple over operation is conducted is set in Step S1701, and the page counter is cleared once in Step S1702. Then, since it is judged that the page counter value of a succeeding page is less than N in Step S1009, the aligning operation of Step S1012 is conducted. In this situation, if that page is a job completion page, it is judged that the job is completed in Step S1013, and the operation is shifted to the stapling operation.

In the third embodiment, a given number of sheets is set to a permissible stapling number of sheets N, but if an arbitrary integer Y of (N−1) or less is set without clearing the page counter to 0 when the page counter is cleared once, a bundle of sheets of the (N−Y) number can be allowed to drop down on the face-down discharge portion 125 of the printer main body 100. In the stapling operation shown in FIG. 11, although not shown, if a flag indicating that the staple over operation is conducted is set, only the sheet aligning operation and the dropping operation are conducted, but the stapling operation is not conducted. Also, as in the second embodiment, a flag indicating that the set staple over operation is conducted is reset after the page information of a succeeding job is indicative of a header page (the operation of Step S907 in FIG. 9) although not shown. By conducting the above-mentioned control, the sheets that are not stapled can be regularly discharged to the face-down discharge portion 125 of the printer main body 100 for each of the sheet bundles.

As described in the above first to third embodiments, according to the present invention, in the sheet post-processing device in which the sheets stacked on the first sheet stacking portion are aligned, and the bundle of sheets are post-processed and then allowed to drop down on the second sheet stacking portion located below the first sheet stacking portion, even in the case where the sheets of the number that exceeds the sheet post-processing permissible number of sheets have been stacked or will be stacked on the first sheet stacking portion, the error handling operation can be conducted at a low cost and under the simple control without any special provision of a new mechanism.

(Fourth Embodiment)

A sheet post-processing device and an image forming apparatus (printer) in accordance with a fourth embodiment have the same structure as that in the first embodiment shown in FIGS. 1 to 7. Description of the identical structure with that in the first embodiment will be omitted.

Among the controls of the CPU 702 of the sheet post-processing deice in accordance with this embodiment, since the initializing operation, the sheet transporting operation, the stapling operation, the sheet aligning control operation, the jam clearance operation, the staple jam clearance operation, the emergent stop/automatic sheet discharge operation are identical with the respective operations in the first embodiment shown in FIGS. 8 and 10 to 15, their descriptions will be omitted. Hereinafter, the standby operation and the non-sheet-transporting operation will be described in accordance with FIGS. 18 and 19.

Figure 18:
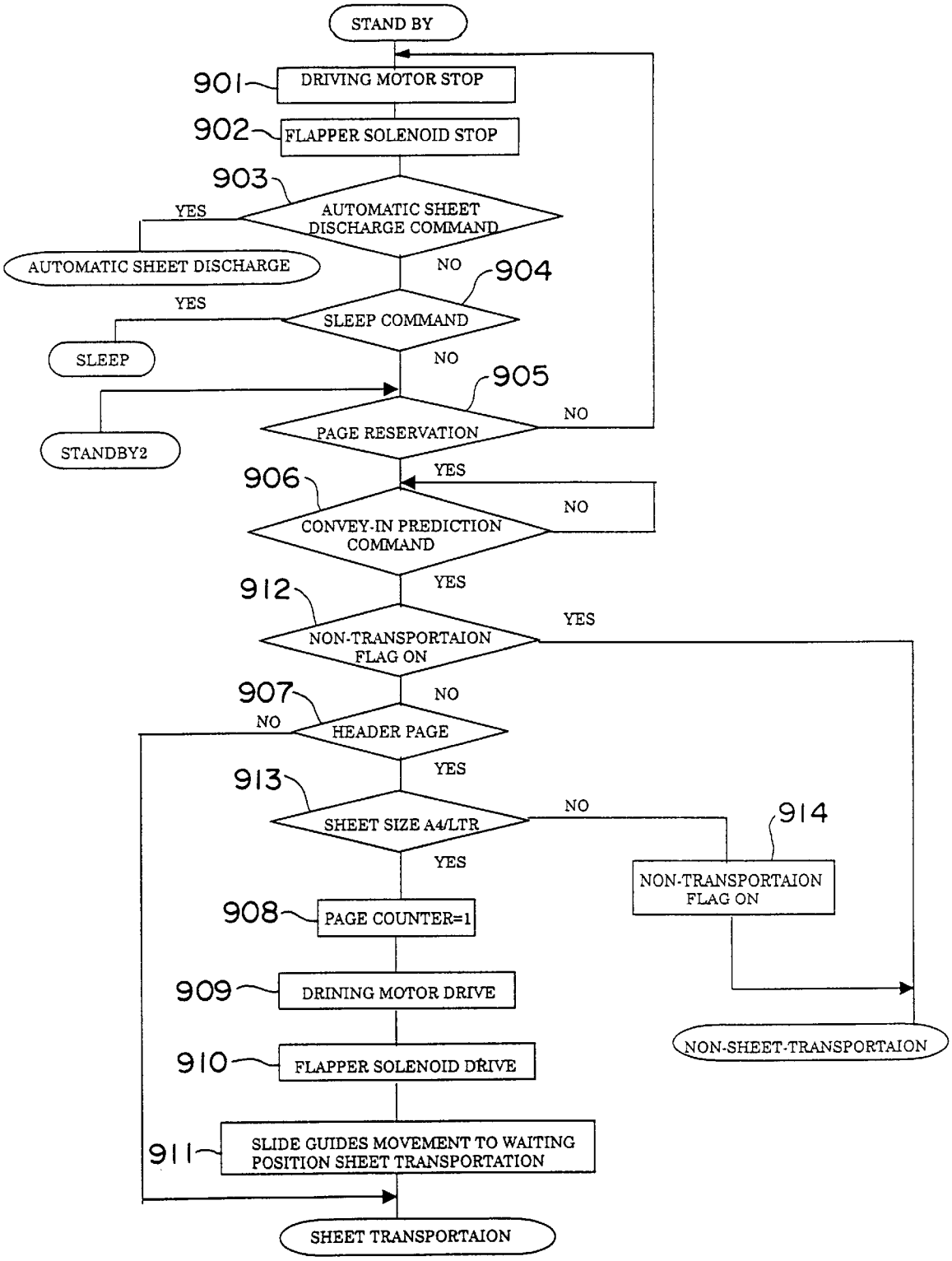
FIG. 18 is a flowchart showing a standby operation of a sheet post-processing device in accordance with a fourth embodiment.

FIG. 18 shows an operation in a state where the sheet post-processing device 300 is on standby.

Among the standby operation of the sheet post-processing device 300 in accordance with this embodiment, an operation of from the stop of the driving motor M (S901) to the waiting for the reception of the convey-in prediction command is identical with that in the first embodiment shown in FIG. 9.

In this embodiment, if the convey-in prediction command is received, it is first judged whether the commanded operation is a non-sheet-transporting operation or a sheet transporting operation (S912).

Figure 19:
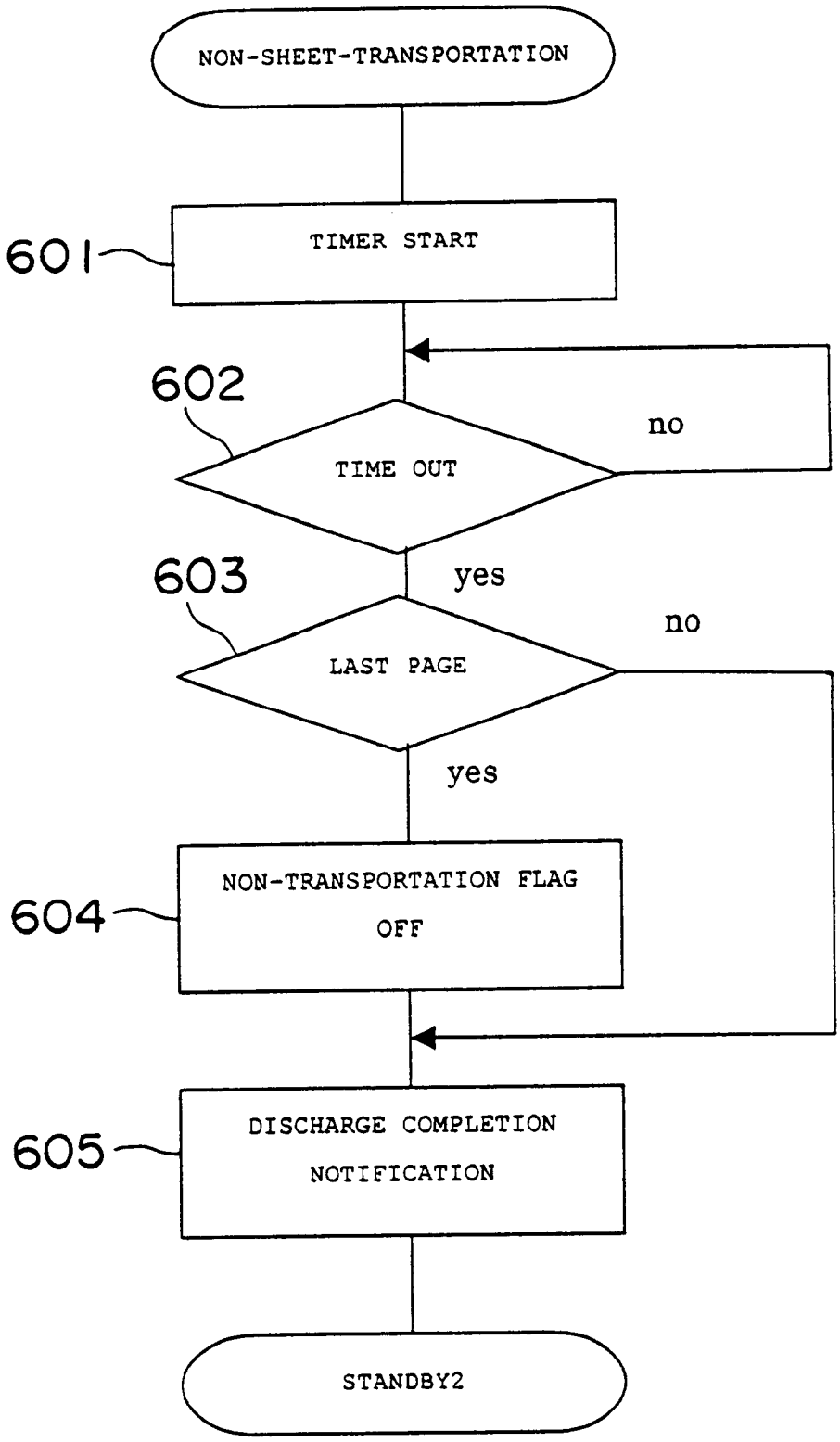
FIG. 19 is a flowchart showing a non-sheet-transporting operation in the sheet post-processing device in accordance with the fourth embodiment.

If it is the non-sheet-transporting operation, the non-sheet-transporting operation shown in FIG. 19 is conducted immediately.

If it is not the non-sheet-transporting operation, it is judged whether the page information corresponding to the convey-in prediction command is "page header", or not (S907), and if it is "page header", it is then judged whether the first sheet of a job that will be processed now is of a size that can be stapled, or not (S913).

If the size is a sheet size that is not processed by the sheet post-processing device, a non-transportation flag is set so that a non-sheet-transporting operation is conducted till a final page of the job now (S914), and a non-sheet-transporting operation shown in FIG. 19 is conducted.

If the size is a sheet size that can be stabled, a page counter of the job is initialized to 1 (S908), the driving motor M1 is driven (S909), the flapper solenoid SL is further driven (S910) and the operation is shifted to the sheet transporting operation.

In addition, the slide guides are moved to a sheet waiting position (S911). Then, in the case where the slide guides are not moved from the initial position although the jogger HP sensor is monitored and the jogger motor M is driven by a given number of steps, a jogger motor failure operation is conducted.

As described above, since the transporting operation is identical with that in the first embodiment shown in FIG. 10, its description will be omitted, and the non-sheet-transporting operation will be described.

FIG. 19 is a flowchart showing the non-sheet-transporting operation.

This operation is executed in the case where the sheet size that cannot be dealt with by the sheet post-processing device is conveyed in from the printer main body 100.

In FIG. 18, after the convey-in prediction command has been received (S906), if the corresponding page information indicates "page header" (S907) and a sheet of a size other than A4/LTR (S913), since the operation of S908 to S911 is not conducted, the flapper solenoid SL, the driving motor M1, the slide guide R310 and the slide guide L311 do not operate.

Therefore, all of the sheets are discharged to the face-down discharge portion 125 of the printer main body 100. Thereafter, the sheets are not discharged to the sheet post-processing device till the final page of the job.

First, in order to measure a period of time during which the discharge of the sheets to the face-down discharge portion 125 of the printer main body 100 will be completed by estimate, the timer starts (S601) to wait for the elapse of that period of time (S602).

It is judged whether that page is a final page of the job, or not, after that period of time has been elapsed (S603), and if the page is the final page, the non-transportation flag is turned off so that the non-sheet-transporting operation is completed (S604).

Then, as in the normal transporting operation, the completion of the sheet discharge is notified the image controller 701 of (S605).

In the operation shown in FIG. 19, since the sheets discharged from the printer main body 100 are simply discharged to the face-down discharge portion 125, it is unnecessary to initialize the page counter and conduct a count-up operation.

As described above, in this embodiment, in the image forming apparatus that discharges the sheets on which an image has been formed onto the upper surface of the apparatus, since the sheet post-processing device is disposed above the discharge portion of the upper surface of the apparatus main body, and the sheets that have been subjected to post-processing by the sheet post-processing device are allowed to drop down on the discharge portion of the apparatus main body side that is positioned to be lower so as to be stacked on the discharge portion, the sheet post-processing device can be simplified and a low cost can be realized.

Then, in the sheet post-processing device according to this embodiment, in case of the sheet size that cannot be dealt with by this sheet post-processing device, control is made so that the sheets are not conveyed into the sheet post-processing device.

Therefore, appropriate operation can be conducted because there is not conducted such a useless process that the sheets are stacked on the face down discharge portion (the discharge sheet stacking portion) without being post-processed after the sheets are introduced into the sheet post-processing device and supported to the slide guides (the sheet support portion) within the sheet post-processing device once regardless of no conduction of the post-processing. Also, because the bundle of sheets are allowed to drop down on the face down discharge portion (the discharge sheet stacking portion) from the slide guides (the sheet support portion) within the sheet post-processing device without being post-processed, there can be prevented such drawbacks that the sheets are stacked on the face down discharge portion (the discharge sheet stacking portion) in disorder or cannot be stacked thereon.

The above description is given of the stapling means as the post-processing means. However, the present invention is not limited to this structure, but the same effects can be obtained if the sheet post-processing with the sheet aligning operation is conducted, for example, even if a punching means that opens a punch hole in a bundle of sheets, a book binding means that adhering the edges of sheets, or other easy binding means is employed.

(Fifth Embodiment)

In the above-mentioned fourth embodiment, the description is given of the example in which the sheets are discharged directly to the face-down discharge portion 125 of the printer main body without introducing the sheets to the sheet post-processing device in case of the sheet size that cannot be dealt with by the sheet post-processing device.

However, the judgment of whether the sheets can be dealt with by the sheet post-processing device, or not, is not limited to the sheet size, but the judgment may be made on the basis of other conditions.

In this embodiment, such a structure will be described.

In this embodiment, it is not judged on the basis of the sheet size whether the sheet post-processing device can deal with the sheets, or not, as in the above fourth embodiment, but the judgment is made on the basis of other conditions or such conditions including the sheet size, and in case of the sheets that cannot be dealt with by the sheet post-processing device, the sheets are discharged to the face-down discharge portion 125 of the printer main body 100.

That is, although not particularly shown, some of the image forming apparatuses provide a function of discriminating the kind of sheets or a function of designating the kind of sheets. By obtaining this information through the communicating means with the image controller 701, it can be judged whether the sheet post-processing device can deal with the sheets in accordance with the kind of sheets, or not.

For example, if the sheet post-processing device can deal with nothing other than a plain paper, in an operation of a flowchart shown in FIG. 18 (S913), it is judged whether the sheet is a plain paper, or not, instead of the judgment of the sheet size, and if the sheet is not the plain paper, the operation is advanced to Step S914. With this operation, sheets that cannot be dealt with by the sheet post-processing device can be readily discharged in accordance with the kind of sheets onto the face-down discharge portion of the printer main body 100.

Also, in the case where the sheet size is judged together with the kind of sheets, after the judgment in Step S913 is yes, it is judged whether the sheet is a plain paper, or not, and if the sheet is not the plain paper, the operation is advanced to Step S914.

If various conditions are set from page information obtained from the image controller 701 in this way, finer sheet transportation can be implemented.

As for the conditions, it may be determined whether the sheet can be supported (stacked) by the sheet supporting means portion 300B, or not, or whether the post-processing can be conducted, or not.

In the former case, because it is determined whether the sheet can be supported, or not, for example, on the basis of the total weight of sheets or the total number of sheets other than the sheet size as described above, those upper limits are set in advance, and it can be judged that the operation cannot be conducted if transmitted information on sheets indicates that those upper limits are exceeded.

In the latter case, if the number of sheets to be processed is determined as in a case of conducting the stapling operation, whether the processing is enabled, or not, is based on the total number of sheets, and if adhering is conducted as in the book binding operation, since there is a case where adhering cannot be conducted depending on the material of the sheets, judgment is made on the basis of the material.

As another case, there is a case where a transporting system within the sheet post-processing device makes it impossible to conduct the operation depending on the kind of sheets. The sheets that can be physically identified are judged as the kind of sheets, such as the sheet weight per one sheet, an OHP sheet, a glossy paper, a colored paper or a perforated paper.

(Sixth Embodiment)

In the above-mentioned fifth embodiment, description is made of an example in which information is supplied to the sheet post-processing device only with respect to the sheets that are going to be post-processed.

However, if the information on all of the sheets that are subjected to an image forming process in the image forming apparatus is supplied to the sheet post-processing device, the control of the sheet post-processing device is remarkably facilitated.

In this embodiment, this case will be described.

The image controller judges whether sheets are discharged to the face-down discharge portion 125 of the printer main body or the sheet post-processing device in accordance with the intended usage in a printing request transmitted from a host computer or a designation.

In this embodiment, the image controller 701 completely ignores the above processing and gives all of page information to the sheet post-processing device. The sheet post-processing device automatically determines whether the sheets are discharged as they are to the face-down discharge portion 125 of the printer main body 100 or introduced into the self device to conduct the post-processing by conducting the operation described in the above-mentioned first embodiment, thereby making it possible to smoothly process the job.

Therefore, the control of the sheet post-processing device by the image controller is remarkably facilitated.

As was described in the above-mentioned fourth to sixth embodiments, according to the present invention, even in the sheets that are going to be post-processed, when the post-processing is not conducted (in the case where the sheets cannot be supported by the sheet supporting means, or in the case where the post-processing cannot be conducted due to the kind of sheets), because the sheets are transported to the discharge sheet stacking portion disposed in the image forming apparatus as it is, the processing can be appropriately conducted without conducting such a useless process that the sheets that will not be post-processed are introduced into the sheet post-processing device, and availability is improved.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A sheet post-processing device, comprising:

a first sheet discharge path through which a sheet transported from an image forming apparatus is transported to sheet stacking means disposed in said image forming apparatus;

first sheet discharge path open/close means which is disposed in said first sheet discharge path, and closes said first sheet discharge path to temporarily support the sheet transported from said image forming apparatus, or opens said first sheet discharge path to transport the sheet transported from said image forming apparatus to said sheet stacking means;

processing means which is disposed in said first sheet discharge path and conducts post-processing with respect to the sheet temporarily supported by said first sheet discharge path open/close means;

sheet discharge path change-over control means that controls sheet discharge path change-over means that changes over a discharge path, to which the sheet discharged from said image forming apparatus is discharged, to said first sheet discharge path or a second sheet discharge path through which the sheet discharged from said image forming apparatus is discharged directly to said sheet stacking means;

error handling operation necessity judging means that judges whether error handling operation that should be conducted with respect to a sheet unsuitable for the post-processing by said processing means is conducted; and error handling means that controls at least one of said first sheet discharge path open/close means and said sheet discharge path change-over means to conduct said error handling operation.

2. A sheet post-processing device according to claim 1, further comprising:

measuring means that measures the number of sheets that are temporarily supported by said first sheet discharge path open/close means;

storing means that stores the number of post-processing permissible sheets N which can be post-processed in said processing means; and comparing means that compares the number of sheets M measured by said measuring means with the number of sheets N stored by said storing means, wherein:

said error handling operation necessity judging means judges that the error handling operation is conducted if a result made by said comparing means satisfies a relationship of M>N; and said error handling means controls said first sheet discharge path open/close means so as to open said first sheet discharge path to transport the sheet temporarily supported by said first sheet discharge path open/close means to said sheet stacking means.

3. A sheet post-processing device according to claim 2, further comprising sheet aligning means that aligns the sheets temporarily supported by said first sheet discharge path open/close means;

wherein if said error handling operation necessity judging means judges that the error handling operation is conducted, said error handling means controls said first sheet discharge path open/close means so as to align only the sheets temporarily supported by said first sheet discharge path open/close means through said sheet aligning means and so as to open said first sheet discharge path to transport the sheets temporarily supported by said first sheet discharge path open/close means to said sheet stacking means.

4. A sheet post-processing device according to claim 2, wherein if said error handling operation necessity judging means judges that the error handling operation is conducted, said error handling means controls said first sheet discharge path open/close means so as to open said first sheet discharge path and transport the (M+1)th and subsequent sheets to said sheet stacking means.

5. A sheet post-processing device according to claim 2, wherein if said error handling operation necessity judging means judges that the error handling operation is conducted, said error handling means controls said sheet discharge path change-over means so as to transport the (M+1)th and subsequent sheets to said second sheet discharge path.

6. A sheet post-processing device according to claim 5, wherein when a relationship of M+X>N is satisfied assuming that the number of sheets transported to said first sheet discharge path is X, said error handling means controls said sheet discharge path change-over means so as to transport the (M+X+1)th and subsequent sheets to said second sheet discharge path.

7. A sheet post-processing device according to claim 2, further comprising sheet aligning means that aligns the sheets temporarily supported by said first sheet discharge path open/close means;

wherein if said error handling operation necessity judging means judges that the error handling is conducted, said error handling means controls said first sheet discharge path open/close means so as to temporarily support the (M+1)th and subsequent sheets every given number of sheets, align the sheets by said sheet aligning means, and transport the sheets to said sheet stacking means.

8. A sheet post-processing device according to claim 7, further comprising communication means that conducts communication with said image forming apparatus, wherein if said error handling operation necessity judging means judges that the error handling operation is conducted, said error handling means, in controlling said first sheet discharge path open/close means so as to temporarily support the (M+1)th and subsequent sheets every given number of sheets, notifies said image forming apparatus of a period of time between a last sheet of a given number of sheets and a succeeding sheet through said communication means, to widen an interval between the sheets transported from said image forming apparatus.

9. A sheet post-processing device according to claim 1, wherein said processing means includes at least one of stapling means that binds sheets by stapling, punching means that punches the sheets, book binding means that binds the sheets by stapling and folds the sheets, and book binding means that adheres edges of the sheets with paste.

10. A sheet post-processing device according to claim 1, further comprising communication means that conducts communication with said image forming apparatus, wherein when said error handling operation necessity judging mean judges that the error handling operation is conducted on the basis of information on the sheets that are going to be post-processed in said processing means which is transmitted from said image forming apparatus by said communication means, said error handling means controls said sheet discharge path change-over means so as to transport the sheets transported from said image forming apparatus to said second sheet discharge path.

11. A sheet post-processing device according to claim 10, wherein said error handling operation necessity judging means judges whether the sheets are suitable for post-processing by said processing means or not on the basis of whether the sheets can be supported by said first sheet discharge path open/close means, and if the sheets cannot be supported by said first sheet discharge path open/close means, said error handling operation necessity judging means judges that the sheets are not post-processed.

12. A sheet post-processing device according to claim 11, wherein whether the sheets can be supported by said first sheet discharge path open/close means is judged on the basis of a sheet size.

13. A sheet post-processing device according to claim 11, wherein whether the sheets can be supported by said first sheet discharge path open/close means is judged on the basis of a sheet weight.

14. A sheet post-processing device according to claim 11, wherein whether the sheets can be supported by said first sheet discharge path open/close means is judged on the basis of the number of sheets.

15. A sheet post-processing device according to claim 2, wherein whether the sheets are suitable for post-processing by said processing means or not is based on whether the kind of sheets is suited to the post-processing by said processing means or not.

16. A sheet post-processing device according to claim 15, wherein the kind of sheets can be physically identified, and includes at least one of a sheet different in the weight per one sheet, an OHP sheet, a glossy paper, a colored paper and a perforated paper.

17. A sheet post-processing device according to claim 1, further comprising communication means that conducts communication with said image forming apparatus;

wherein when said sheet post-processing device per se is in an abnormal state, error handling operation necessity judging means judges that the post-processing is not conducted regardless of the contents of information on a sheet which is transmitted from said image forming apparatus by said communication means.

18. A sheet post-processing device according to claim 1, further comprising communication means that conducts communication with said image forming apparatus;

wherein information on only the sheets that are going to be post-processed by said image forming apparatus is transmitted from said image forming apparatus through said communication means.

19. A sheet post-processing device according to claim 1, further comprising communication means that conducts communication with said image forming apparatus;

wherein information on all of the sheets that are subjected to an image forming process by said image forming apparatus is transmitted from said image forming apparatus through said communication means.

20. A sheet post-processing device according to claim 1, wherein said first sheet discharge path open/close means is disposed above said sheet stacking means disposed on an upper surface of said image forming apparatus main body.

21. An error handling method with respect to a sheet that is not suitable for post-processing in an image forming apparatus having a sheet post-processing device that conducts the post-processing on the discharged sheet, wherein:

said sheet post-processing device comprises:

a first sheet discharge path through which the sheet transported from said image forming apparatus is transported to a sheet stacking means disposed in said image forming apparatus;

first sheet discharge path open/close means which is disposed in said first sheet discharge path, and closes said first sheet discharge path to temporarily support the sheet transported from said image forming apparatus, or opens said first sheet discharge path to transport the sheet transported from said image forming apparatus to said sheet stacking means; and processing means which is disposed in said first sheet discharge path and conducts post-processing with respect to the sheet temporarily supported by said first sheet discharge path open/close means;

said image forming apparatus comprises:

image forming means that forms an image on the sheet;

said sheet stacking means; and sheet discharge path change-over means that changes over a discharge path, to which the sheet discharged from said image forming apparatus is discharged, to any one of said first sheet discharge path and a second sheet discharge path along which the sheet discharged from said image forming apparatus is discharged directly to said sheet stacking means; and said method comprises the steps of:

judging whether the error handling operation is conducted or not; and if said error handling operation is conducted, controlling at least any one of said first sheet discharge path open/close means and said sheet discharge path change-over means to conduct said error handling operation.

22. An error handling method according to claim 21, further comprising the steps of:

comparing the number of sheets M that are temporarily supported by said first sheet discharge path open/close means with the number of post-processing permissible sheets N which can be post-processed in said processing means;

judging that the error handling operation is conducted if a relationship of M>N is satisfied; and if said error handling operation is conducted, opening said first sheet discharge path to transport the sheets temporarily supported by said first sheet discharge path open/close means to said sheet stacking means.

23. An error handling method according to claim 22, wherein if said error handling operation is conducted, said method further comprises the steps of aligning the sheets temporarily supported by said first sheet discharge path open/close means, and opening said first sheet discharge path open/close means so as to transport the sheets temporarily supported by said first sheet discharge path open/close means to said sheet stacking means.

24. An error handling method according to claim 22, wherein if said error handling operation is conducted, said method further comprises the step of opening said first sheet discharge path open/close means so as to transport the (M+1)th and subsequent sheets transported from said image forming apparatus to said sheet stacking means.

25. An error handling method according to claim 22, wherein if said error handling operation is conducted, said method further comprises the step of controlling said sheet discharge path change-over means so as to transport the (M+1)th and subsequent sheets to said second sheet discharge path.

26. An error handling method according to claim 21, wherein:

assuming that the number of sheets temporarily supported by said first sheet discharge path open/close means is M, the number of sheets conveyed into said first sheet discharge path is X, and the permissible post-processing number of sheets that can be post-processed in said processing means is N, when a relationship of M+X>N is satisfied, it is judged that the error handling operation is conducted; and if said error handling operation is conducted, said method further comprises the steps of opening said first sheet discharge path open/close means so as to transport the sheets temporarily supported by said sheet discharge path open/close means to said sheet stacking means, and controlling said sheet discharge path change-over means so as to guide the (M+X+1)th and subsequent sheets to said second sheet discharge path.

27. An error handling method according to claim 22, wherein:

if the error handling operation is conducted, said method further comprises the steps of:

temporarily supporting the (M+1)th and subsequent sheets by said first sheet discharge path open/close means every given number of sheets;

aligning the sheets temporarily supported by said first sheet discharge path open/close means; and opening said first sheet discharge path open/close means so as to transport the aligned sheets to said sheet stacking means.

28. The error handling method according to claim 27, wherein:

further comprising the steps of widening an interval between a last sheet of the given number of sheets and a sheet that is transported next when said first sheet discharge path open/close means temporarily supports the (M+1)th and subsequent sheets every given number of sheets.

29. An error handling method according to claim 21, wherein the post-processing includes at least one of stapling for binding the sheets by stapling, punching for punching the sheets, book binding operation for binding the sheets by stapling and folding the sheets, and book binding for adhering edges of the sheet with paste.

30. An error handling method according to claim 21, further comprising the steps of:

transmitting information on the sheets that are going to be post-processed in said sheet processing means from said image forming apparatus to said sheet post-processing device; and if it is judged that the error handling operation is conducted on the basis of the sheet information, controlling said sheet discharge path change-over means so as to guide the sheets transported from said image forming apparatus to said second sheet discharge path.

31. An error handling method according to claim 30, wherein whether the sheets are suitable for the post-processing is judged on the basis of whether the sheets can be supported by said first sheet discharge path open/close means or not, and if the sheets cannot be supported by said first sheet discharge path open/close means, it is judged that the sheets are not post-processed.

32. An error handling method according to claim 31, wherein whether the sheets can be supported by said first sheet discharge path open/close means is judged on the basis of a sheet size.

33. An error handling method according to claim 31, wherein whether the sheets can be supported by said first sheet discharge path open/close means is judged on the basis of a sheet weight.

34. An error handling method according to claim 31, wherein whether the sheets can be supported by said first sheet discharge path open/close means is judged on the basis of the number of sheets.

35. An error handling method according to claim 21, wherein the judgment on whether the sheets are suitable for the post-processing is judged on the basis of the number of sheets.

36. An error handling method according to claim 21, wherein whether the sheets are suitable for the post-processing is based on whether the kind of sheets is suitable for the post-processing by said processing means or not.

37. An error handling method according to claim 36, wherein the kind of sheets can be physically identified, and includes at least one of a sheet different in the weight per one sheet, an OHP sheet, a glossy paper, a colored paper and a perforated paper.

38. An error handling method according to claim 21, wherein when said sheet post-processing device per se is in an abnormal state, it is judged that the post-processing is not conducted regardless of the contents of the sheet information.

39. A sheet post-processing device, comprising:

a first sheet discharge path through which a sheet transported from an image forming apparatus is transported to sheet stacking means disposed in said image forming apparatus;

first sheet discharge path open/close means which is disposed in said first sheet discharge path, and closes said first sheet discharge path to temporarily support the sheet transported from said image forming apparatus, or opens said first sheet discharge path to transport the sheet transported from said image forming apparatus to said sheet stacking means;

binder which is disposed in said first sheet discharge path and conducts post-processing with respect to the sheet temporarily supported by said first sheet discharge path open/close means;

sheet discharge path change-over controller that controls sheet discharge path change-over means that changes over a discharge path, to which the sheet discharged from said image forming apparatus is discharged, to said first sheet discharge path or a second sheet discharge path through which the sheet discharged from said image forming apparatus is discharged directly to said sheet stacking means;

error handling operation necessity judging means that judges whether error handling operation that should be conducted with respect to a sheet unsuitable for the post-processing by said processing means is conducted or not; and error handling controller that controls at least one of said first sheet discharge path open/close means and said sheet discharge path change-over controller to conduct said error handling operation.

40. An image forming apparatus, comprising:

a first sheet discharge path through which a sheet transported from an image forming means is transported to sheet stacking means;

first sheet discharge path open/close means which is disposed in said first sheet discharge path, and closes said first sheet discharge path to temporarily support the sheet transported from said image forming means, or opens said first sheet discharge path to transport the sheet transported from said image forming means to said sheet stacking means;

processing means which is disposed in said first sheet discharge path and conducts post-processing with respect to the sheet temporarily supported by said first sheet discharge path open/close means;

sheet discharge path change-over control means that controls sheet discharge path change-over means that changes over a discharge path, to which the sheet discharged from said image forming means is discharged, to said first sheet discharge path or a second sheet discharge path through which the sheet discharged from said image forming means is discharged directly to said sheet stacking means;

error handling operation necessity judging means that judges whether error handing operation that should be conducted with respect to a sheet unsuitable for the post processing by said processing means is conducted or not; and error handing means that controls at least one of said first sheet discharge path open/close means and said sheet discharge path change-over means to conduct said error handling operation.

41. An image forming apparatus according to claim 40, further comprising:

measuring means that measures the number of sheets that are temporarily supported by said first sheet discharge path open/close means;

storing means that stores the number of post-processing permissible sheets N which can by post-processed in said processing means; and comparing means that compares the number of sheets M measured by said measuring means with the number of sheets N stored by said storing means, wherein:

said error handling operation necessity judging means judges that the error handling operation is conducted if a result made by said comparing means satisfies a relationship of M>N; and said error handing means controls said first sheet discharge path open/close means so as to open said first sheet discharge path to transport the sheet temporarily supported by said first sheet discharge path open/close means to said sheet stacking means.

42. An image fanning apparatus according to claim 41, further comprising sheet aligning means that aligns the sheets temporarily supported by said first sheet discharge path open/close means;

wherein if said error handling operation necessity judging means judges that the error handling operation is conducted, said error handling means controls said first sheet discharge path open/close means so as to align only the sheets temporarily supported by said first sheet discharge path open/close means through said sheet aligning means and so as to open said first sheet discharge path to transport the sheets temporarily supported by said first sheet discharge path open/close means to said sheet stacking means.

43. An image forming apparatus according to claim 41, wherein said error handling means controls said first sheet discharge path open/close means so as to open said first sheet discharge path and transport the (M+1)th and subsequent sheets to said sheet stacking means.

44. An image forming apparatus according to claim 41, wherein said error handling means controls said sheet discharge path change-over means so as to transport the (M±1)th and subsequent sheets to said second sheet discharge path.

45. An error handling method with respect to a sheet that is not suitable for post-processing in an image forming apparatus having a sheet post-processing device that conducts the post-processing on the discharged sheet, wherein:

said image forming apparatus comprises:

a first sheet discharge path through which the sheet transported from an image forming means is transported to a sheet stacking means;

first sheet discharge path open/close means which is disposed in said first sheet discharge path, and closes said first sheet discharge path to temporarily support the sheet transported from said image forming means, or opens said first sheet discharge path to transport the sheet transported from said image fanning means to said sheet stacking means; and processing means which is disposed in said first sheet discharge path and conducts post-processing with respect to the sheet temporarily supported by said first sheet discharge path open/close means;

sheet discharge path change-over means that changes over a discharge path, to which the sheet discharged from said image forming means is discharged, to any one of said first sheet discharge path and a second sheet discharge path along which the sheet discharged from said image forming means is discharged directly to said sheet stacking means; and said method comprises the steps of:

judging whether the error handling operation is conducted; and if said error handling operation is conducted, controlling at least any one of said first sheet discharge path open/close means and said sheet discharge path change-over means to conduct said error handling operation.

46. An error handling method according to claim 45, further comprising the steps of:

comparing the number of sheets M that are temporarily supported by said first sheet discharge path open/close means with the number of post-processing permissible sheets N which can be post-processed in said processing means;

judging that the error handling operation is conducted if a relationship of M>N is satisfied; and if said error handling operation is conducted, opening said first sheet discharge path to transport the sheets temporarily supported by said first sheet discharge path open/close means to said sheet stacking means.

47. An error handling method according to claim 46, wherein if said error handling operation is conducted, said method further comprises the steps of aligning the sheets temporarily supported by said first sheet discharge path open/close means, and opening said first sheet discharge path open/close means so as to transport the sheets temporarily supported by said first sheet discharge path open/close means to said sheet slacking means.

48. An error handling method according to claim 46, further comprising the steps of opening said first sheet discharge path open/close means so as to transport the (M+1) th and subsequent sheets transported from image fanning means to said sheet stacking means.

49. An error handling method according to claim 46, further comprising the step of controlling said sheet discharge path change-over means so as to transport the (M+1)th and subsequent sheets to said second sheet discharge path.

* * * * *

UNITED STATES PATENT AND TRADEMARK OFFICE

CERTIFICATE OF CORRECTION

PATENT NO. : 6,674,976 B2
DATED : January 6, 2004
INVENTOR(S) : Kaoru Sato et al.

It is certified that error appears in the above-identified patent and that said Letters Patent is hereby corrected as shown below:

Column 4,
Line 11, “a” (2nd occurrence) should read -- an --.

Column 8,
Line 52, “no” should read -- any --.

Column 10,
Line 51, “moves” should read -- move --.
Lines 57 and 61, “both the” should read -- both --.

Column 12,
Line 61, “a” should read -- an --.

Column 13,
Lines 33 and 36, “is” should read -- are --.

Column 15,
Line 56, “a” should read -- an --.

Column 16,
Line 54, “a” should read -- an --.

Column 17,
Line 24, “stops” should read -- stop --.

Column 18,
Line 34, “adhering” should read -- adheres --.
Line 35, “is” should read -- are --.

Column 19,
Line 26, “exceed” should read -- exceeds --.

Column 22,
Line 43, “deice” should read -- device --.

Column 23,
Line 12, “stabled,” should read -- stapled, --.

Column 24,
Line 33, “adhering” should read -- adheres --.
Line 34, “is” should read -- are --.

UNITED STATES PATENT AND TRADEMARK OFFICE

CERTIFICATE OF CORRECTION

PATENT NO. : 6,674,976 B2
DATED : January 6, 2004
INVENTOR(S) : Kaoru Sato et al.

It is certified that error appears in the above-identified patent and that said Letters Patent is hereby corrected as shown below:

Column 30,
Line 61, “wherein” should be deleted.

Column 34,
Line 38, “slacking” should read -- stacking --.
Line 44, “fanning” should read -- forming --.

Signed and Sealed this

Twenty-fifth Day of May, 2004

JON W. DUDAS
*Acting Director of the United States Patent and Trademark Office*